US012729532B2

(12) United States Patent
Bogh

(10) Patent No.: US 12,729,532 B2
(45) Date of Patent: Sep. 8, 2026

(54) MODULAR POST-TENSIONED SHEAR RESISTING SYSTEM AND METHOD OF INSTALLATION

(71) Applicant: Verco Decking, Inc., Phoenix, AZ (US)

(72) Inventor: Brian Hansen Bogh, Calimesa, CA (US)

(73) Assignee: Verco Decking, Inc., Phoenix, AZ (US)

( * ) Notice: Subject to any disclaimer, the term of this patent is extended or adjusted under 35 U.S.C. 154(b) by 227 days.

(21) Appl. No.: 18/371,854

(22) Filed: Sep. 22, 2023

(65) Prior Publication Data

US 2024/0110375 A1 Apr. 4, 2024

Related U.S. Application Data

(60) Provisional application No. 63/411,159, filed on Sep. 29, 2022.

(51) Int. Cl.
*E04B 1/34* (2006.01)
*E04B 1/348* (2006.01)

(52) U.S. Cl.
CPC ..... *E04B 1/34853* (2013.01)

(58) Field of Classification Search
CPC ..... E04B 2/84; E04B 2/86; E04B 2/24; E04B 2/26; E04B 2/40; E04B 2/34; E04B 2/38; E04G 21/12; E04G 13/02; E04C 3/34
USPC ... 52/223.6, 236.3, 252, 169.13, 236.8, 240, 52/243, 742.14, 745.17
See application file for complete search history.

(56) References Cited

U.S. PATENT DOCUMENTS 1,787,107 A * 12/1930 Harper ..... E04G 11/04 249/168
3,782,061 A * 1/1974 Minutoli ..... E04B 1/06 52/298
8,919,058 B2 * 12/2014 Liberman ..... E04B 1/34384 52/79.9
2012/0047816 A1 * 3/2012 Zhong ..... E04C 3/34 52/220.1

FOREIGN PATENT DOCUMENTS

WO WO-2011003212 A1 * 1/2011 ..... E04B 1/22

* cited by examiner

*Primary Examiner* — Patrick J Maestri
(74) *Attorney, Agent, or Firm* — Moore & Van Allen PLLC; Jeffrey R. Gray

(57) ABSTRACT

A modular post-tensioned shear system having a plurality of modular sections stacked on top of each other. Each modular section having one or more hollow structural section (HSS) members and one or more form walls. Each modular section having a post-tensioning assembly within the one or more hollow HSS members forming an HSS post-tensioning assembly. The post-tensioning assembly having two or more conduit members (e.g., hollow tubes located within the stacked HSS members) coupled together through conduit couplings, two or more tensioning members (e.g., rebar, cables, or the like located within the conduit members) coupled together through tensioning couplings, and a tensioning lock (e.g., bearing member, locking coupling, or the like) that tensions the HSS post-tensioning assembly after installation. The modular structural shear system provides improved resistance to cyclic loading and/or improved assembly during construction (e.g., within new structures, retrofitting older structures, or the like).

25 Claims, 37 Drawing Sheets

SECTION A

MODULAR POST-TENSIONED SHEAR RESISTING SYSTEM AND METHOD OF INSTALLATION

CROSS REFERENCE AND PRIORITY CLAIM UNDER 35 U. S. C. § 119

This application claims priority to U.S. Provisional Application No. 63/411,159 entitled "Modular Post-Tensioned Shear Resisting System and Method of Installation" filed on Sep. 29, 2022, which is assigned to the assignee hereof and the entirety of which is incorporated by reference herein.

FIELD

This application relates generally to the field of shear resisting structures, and more particularly, to improvements to post tensioned shear resisting structures and the installation of the post tensioned shear resisting structures.

BACKGROUND

Traditional structures, such as shear walls or load bearing walls, are made of concrete and steel reinforcement (e.g., rebar, or the like). Concrete structures require steel reinforcement, in particular rebar, primarily to increase the tension strength of the concrete structure. In order to provide the desired shear resistance or load capacity, large amounts of rebar and thick concrete walls are typically required, in particular, for providing the desired shear and loading properties in seismic areas. As such, in seismic areas the rebar and concrete may be considerable in order to provide the desired structural properties. Moreover, in some applications, such as elevators, stairs, or building element (e.g., electrical, heating and cooling, or the like) cores, the concrete serves as a fire barrier that provides high-temperature resistance.

BRIEF SUMMARY

The modular post-tensioned shear resisting systems described herein (e.g., the modular post-tensioned shear wall system, post-tensioned shear system having different shapes, or the like), having the post-tensioning assemblies, and components thereof, provide improved systems for providing the desired shear and/or loading properties when compared to traditional concrete rebar structures. It should be understood that the modular post-tensioned shear systems described herein may be directly coupled to the foundation (e.g., at the wall, pile, support, or the like), the ground below the building, and/or other building support in some applications; however, in other applications the modular post-tensioned shear systems may be coupled to the foundation, the ground, and/or other building support using energy dissipation devices such that the modular post-tensioned shear system rocks and self-centers when exposed to cyclic or other loading. Regardless of the particular application, the modular post-tensioned shear system described herein provides for improved assembly during construction (e.g., within new structures, retrofitting older structures, or the like). In particular, as will be described herein the modular post-tensioned shear system of the present disclosure allows for assembly of the post-tensioning systems (or components thereof) as the one or more modular sections are installed. Furthermore, as will be described herein, the modular post-tensioned shear system greatly reduces the amount of rebar (or other structural members) and concrete (or other fill material) needed to provide the shear resistant properties to the structure.

Regardless of the shape of the modular post-tensioned shear system and/or the number of walls (e.g., may be a modular post-tensioned shear system that is a single wall), the modular post-tensioned shear system may comprise of a plurality of modular sections (e.g., otherwise described as modules) stacked on top of each other, such as a first modular section, a second modular section, $N^{th}$ modular section, or the like. Each modular section may comprise one or more hollow structural section (HSS) members, such as a first end HSS member (otherwise described as a first boundary HSS member), a second end HSS member (otherwise described as a second boundary HSS member), and/or one or more intermediate HSS members (otherwise described as one or more interior HSS members). Moreover, each modular section may further comprise one or more form walls, comprising one or more panels, one or more longitudinal wall members, one or more transverse wall members, and one or more vertical members that may be used to operatively couple the shear wall to the one or more HSS members and/or to one or more adjacent form walls. It should be understood that the one or more panels of the form walls may be made of any type of material (e.g., metal, wood, plastic, composite, or other material), and may be flat, fluted (e.g., with any type of profile as described herein), or have any size or shape. Moreover, the panels may be permanent or removeable from the post-tensioned shear system described herein, such that after fill material is poured into the form wall, the one or more panels may remain in place, or may be removable.

Each modular section comprises a post-tensioning assembly within an HSS member, which when assembled between the plurality of modular sections, forms an HSS post-tensioned system. As will be described in further detail herein, the post-tensioning assembly may comprise two or more conduit members (e.g., hollow tubes located within the stacked HSS members) coupled together through conduit couplings, two or more tensioning members (e.g., rebar, bars, cables, or the like located within the conduit members) coupled together through tensioning couplings, and a tensioning lock (e.g., bearing member, locking coupling, or the like) that is used to tension the HSS post-tensioned system after installation. Moreover, in some embodiments conduit fill material may be located within the two or more conduit members and around the two or more tensioning members after being tensioned. However, in some embodiments, the area between the conduit members and the tensioning members may not include any fill material, which in some embodiments may require the tensioning members to be galvanized (e.g., for protection from exposure to air). As will be described in further detail herein, the modular system described herein allows for the forming of the HSS post-tensioned system as each module of the structure is assembled.

One embodiment of the present disclosure is a modular post-tensioned shear system. The system comprises two or more modular sections stacked on top of each other. Each of the two or more modular sections comprise two boundary hollow structural section (HSS) members, a form wall operatively coupled between the two boundary HSS members, and a post tensioning assembly in each of the two boundary HSS members. The lower end of each of the two boundary HSS members of an upper module is operatively coupled to an upper end of the two boundary HSS members of a lower module.

In further accord with embodiments, the post tensioning assembly in each of the two boundary HSS members comprises two or more conduit members operatively coupled together.

In other embodiments, ends of adjacent conduit members are operatively coupled through a conduit coupling.

In yet other embodiments, the post tensioning assembly further comprises in each of the two boundary HSS members, two or more tensioning members operatively coupled together located within the two or more conduit members.

In still other embodiments, ends of adjacent tensioning members are operatively coupled through a tensioning coupling.

In other embodiments, the ends of the two or more tensioning members comprise threaded bar ends, and the tensioning coupling comprises internal threads for operatively coupling the ends of the adjacent tensioning members.

In further accord with embodiments, the two or more tensioning members comprise two or more cables, and the tensioning coupling comprises a cable coupling.

In other embodiments, the post tensioning assembly further comprises a tensioning lock that tensions the two or more tensioning members of the post tensioning assembly.

In yet other embodiments, the tensioning lock comprises a bearing member operatively coupled to an upper surface of a top HSS member or a top conduit member, and a locking nut operatively coupled to an end of a top tensioning member. The locking nut tensions the two or more tensioning members as the locking nut bears against the bearing member and pulls on the two or more tensioning members.

In still other embodiments, the post tensioning assembly in each of the two boundary HSS members further comprises conduit fill material. The two or more conduit members are filled with the conduit fill material around the two or more tensioning members after the two or more tensioning members are tensioned.

In other embodiments, the upper end of each of the two boundary HSS members of the upper module are operatively coupled to the lower end of each of the two boundary HSS members of the lower module through an HSS coupling.

In further accord with embodiments, the HSS coupling comprises one or more brackets, and a plurality of fasteners operatively coupling the one or more brackets to the upper end and the lower end of each of the two boundary HSS members.

In other embodiments, lattice members are operatively coupled between the two boundary HSS members.

In still other embodiments, the two boundary HSS members each comprise four sides and a plurality of coupling members are operatively coupled to the HSS members and the lattice members.

In yet other embodiments, HSS fill material is located between an inner surface of each of the two boundary HSS members and an outer surface of each of the two or more conduit members.

In other embodiments, the form wall comprises a plurality of wall members, and one or more panels operatively coupled to the plurality of wall members.

In further accord with embodiments, the plurality of wall members comprise vertical members, longitudinal members operatively coupled between the vertical members, and transverse members operatively coupled between the longitudinal members. The one or more panels are operatively coupled to the longitudinal members, and the vertical members are operatively coupled to the two boundary HSS members.

In other embodiments, the one or more panels comprise fluted decking.

In yet other embodiments, the one or more panels forms a wall cavity, and wherein the wall cavity is filled with a panel fill material.

In still other embodiments, each of the two or more modular sections comprise a third boundary HSS member, and a second form wall between the third boundary HSS member and a second boundary HSS member. The two or more modular sections comprise L-shaped modular sections.

In other embodiments, each of the two or more modular sections comprise a fourth boundary HSS member, a third form wall between the third boundary HSS member and the fourth boundary HSS member, and a fourth form wall between the fourth boundary HSS member and a first boundary HSS member. The two or more modular sections comprise square shaped or rectangular shaped modular sections.

In further accord with embodiments, the system further comprises one or more energy dissipation devices. The one or more energy dissipation devices operatively couple a first wall portion to a second wall portion of the form wall or operatively coupled the two or more modular sections to a base module.

In other embodiments, the one or more energy dissipation devices comprise a ductile fuse, a viscous damper, or a bucking brace.

In still other embodiments, the one or more energy dissipation devices comprise a wall energy dissipation device. At least one of the two or more modular sections further comprise a first intermediate HSS member operatively coupled to the first wall portion of the form wall and a first end of the wall energy dissipation device, and a second intermediate HSS member operatively coupled to a second end of the wall energy dissipation device and the second wall portion of the form wall.

Another embodiment of the present disclosure is a post-tensioned shear wall module for a post-tensioned shear wall system, wherein the post-tensioned shear wall module comprises two boundary hollow structural section (HSS) members, and a form wall operatively coupled between the two boundary HSS members.

Another embodiment of the present disclosure is a method of installing a modular post-tensioned shear system. The method comprises installing two first tensioning members to a base module, a foundation, a support member, or two lower tensioning members of a lower module. The method further comprises installing two first conduit members to the base module, the foundation, the support member, or the two lower conduit members of the lower module. Each of the two first conduit members surround each of the two first tensioning members. The method also comprises installing a first modular section over the two first tensioning members and the two first conduit members. The method further comprises installing two second tensioning members to the two first tensioning members and installing two second conduit members to the two first conduit members. Each of the two second conduit members surround each of the two second tensioning members. The method additionally comprises installing a second modular section to the first module section over the two second tensioning members and the two second conduit members.

To the accomplishment of the foregoing and the related ends, the one or more embodiments of the invention comprise the features hereinafter fully described and particularly pointed out in the claims. The following description and the annexed drawings set forth certain illustrative features of the one or more embodiments. These features are indicative, however, of but a few of the various ways in which the principles of various embodiments may be employed, and this description is intended to include all such embodiments and their equivalents.

BRIEF DESCRIPTION OF DRAWINGS

The drawings illustrate embodiments of the invention, and are not necessarily drawn to scale, wherein.

DETAILED DESCRIPTION

Figure 1A:
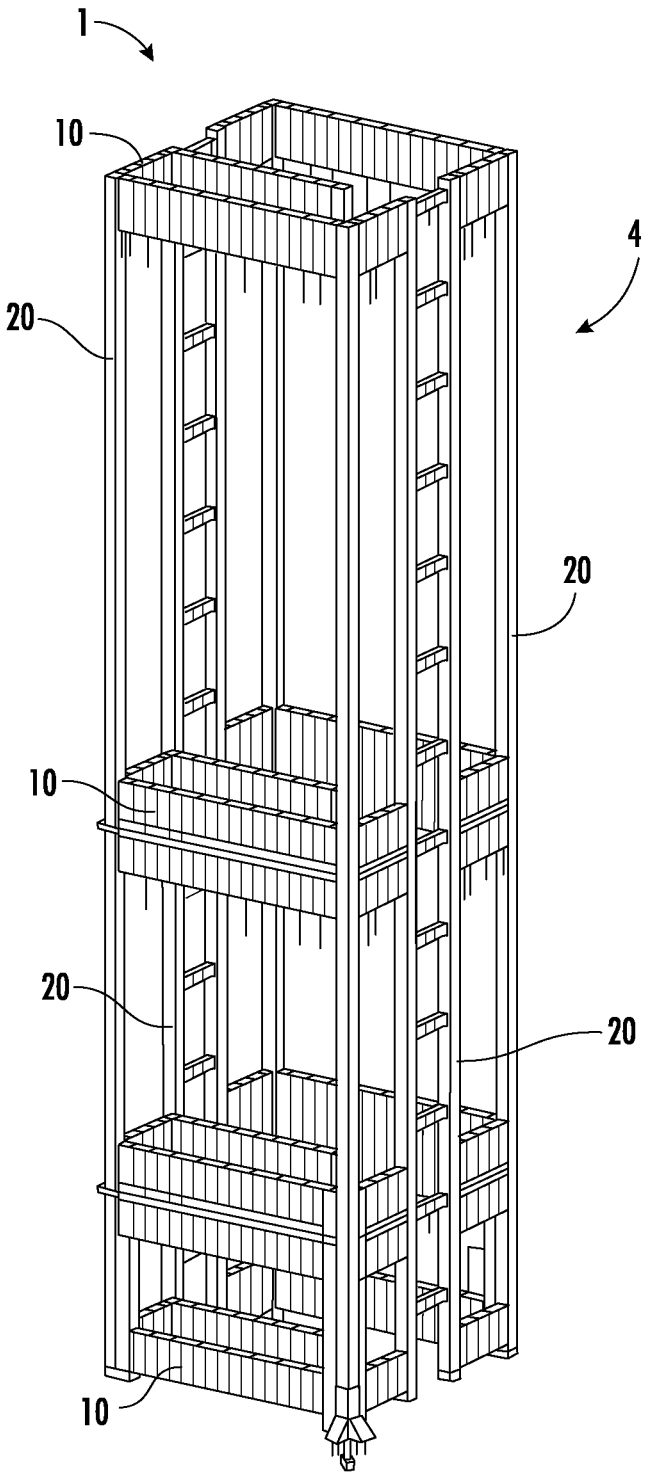
FIG. 1A illustrate a perspective view of a modular post-tensioned shear-resisting structure with shear modules or portions thereof removed for illustrative purposes, in accordance with embodiments of the present disclosure.

Embodiments of the present invention now may be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure may satisfy applicable legal requirements. Like numbers refer to like elements throughout.

FIGS. 1A through 12B illustrate embodiments of a modular post-tensioned shear system 1 (otherwise described as a modular post-tensioned shear resisting system, or the like) having a single wall or two or more walls. As will be described herein, the modular post-tensioned shear system 1 may comprise a modular single wall 2, an L-shaped system with two walls 2, a c-shaped system having three walls 2, a square system 4 having four walls 2, a rectangular system 6 having four walls 2, a z-shaped system having three walls 2, or the like, or combinations of systems that are connected or spaced apart from each other within a building. It should be further understood that the modular post-tensioned shear system 1 may be formed while the building is being constructed, or alternatively, used to retrofit an existing building in order to allow the building to meet higher levels of code enforcement for cyclic loading (e.g., seismic loading, or the like).

Figure 1B:
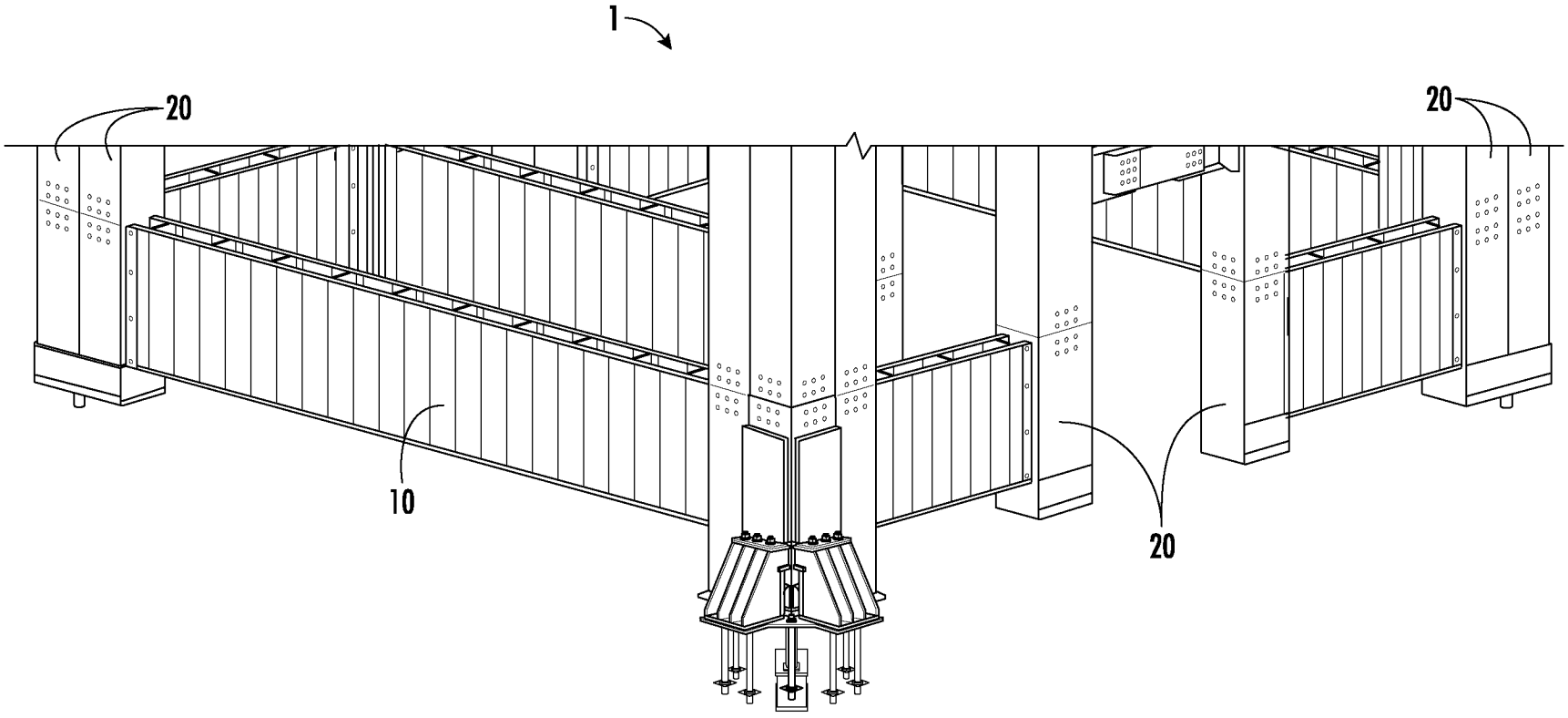
FIG. 1B illustrates a perspective view of a lower portion of the modular post-tensioned shear-resisting structure, in accordance with embodiments of the present disclosure.
Figure 1C:
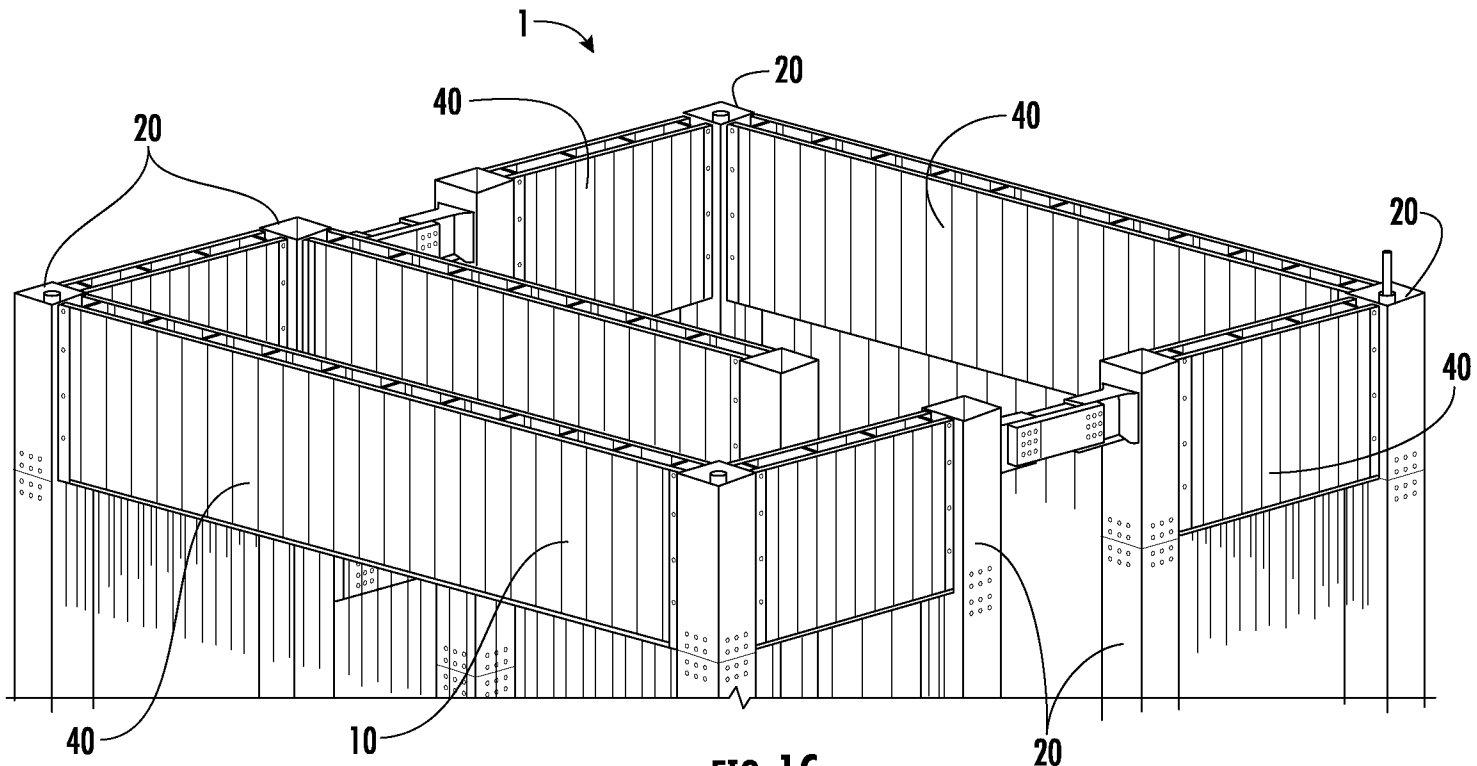
FIG. 1C illustrates a perspective view of an upper portion of the modular post-tensioned shear-resisting structure, in accordance with embodiments of the present disclosure.
Figure 1D:
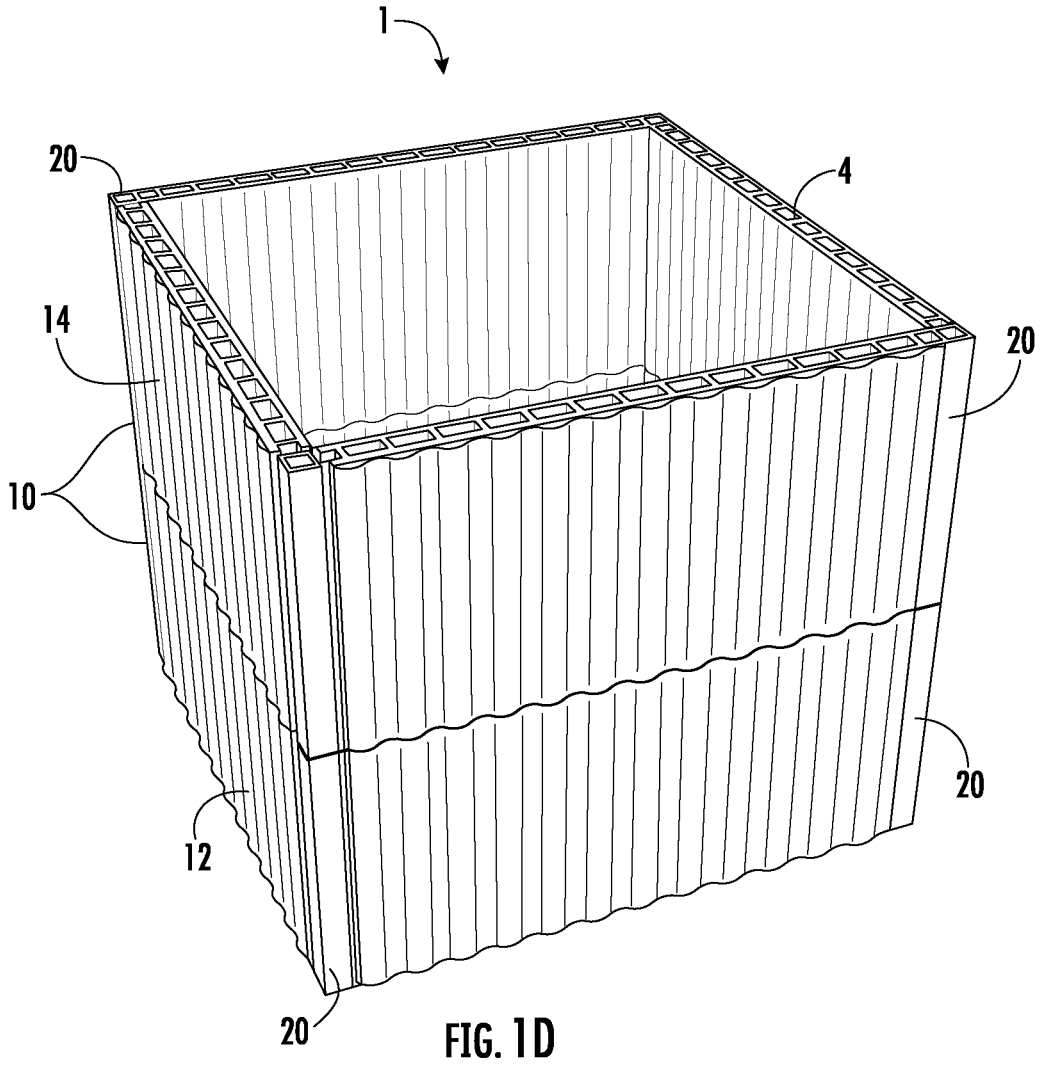
FIG. 1D illustrates a perspective view of shear modules having four walls stacked on each other, in accordance with embodiments of the present disclosure.

FIGS. 1A through 1D illustrate embodiments of the modular post-tensioned shear system 1 with various components removed for illustrative purposes. For example, FIG. 1A illustrates a modular post-tensioned shear system 1 for a core (e.g., elevator core, stair, core, building elements/components core, or the like, or combinations thereof). The modular post-tensioned shear system 1 has some of the form walls 40 and/or portions thereof removed to illustrate different sections of the modular post-tensioned shear system 1. Moreover, FIG. 1B illustrates a lower portion of the modular post-tensioned shear system 1 including the connection the ground, while FIG. 1C illustrates an upper portion of the modular post-tensioned shear system 1 including the locations at which the post-tensioning may occur. Finally, FIG. 1D illustrates two modular sections 10 of the modular post-tensioned shear system 1. Regardless of the shape of the modular post-tensioned shear system 1 and/or the number of walls 2, as illustrated in FIGS. 1A through 1D, it may comprise of a plurality of modular sections 10 (e.g., otherwise described as modules) stacked on top of each other, such as a first modular section 12, a second modular section 14, $n^{th}$ modular section, or the like. Each modular section 10 may comprise one or more hollow structural section (HSS) members 20, such as a first end HSS member 22 (otherwise described as a first boundary HSS member), a second end HSS member 24 (otherwise described as a second boundary HSS member), and/or one or more intermediate HSS members 26 (otherwise described as one or more interior HSS members 26), as will be described in further detail herein. Moreover, each modular section 10 may further comprise one or more form walls 40, comprising one or more panels 50, one or more longitudinal wall members 70, one or more transverse wall members 80, and one or more vertical members 90 that may be used to operatively couple the form wall 40 to the one or more HSS members 20 and/or to one or more adjacent form walls 40. Moreover, each modular section 10 may comprise a post-tensioning assembly 100 within an HSS member), which when assembled between the plurality of modular sections 10 form an HSS post-tensioned system 150.

Figure 2A:
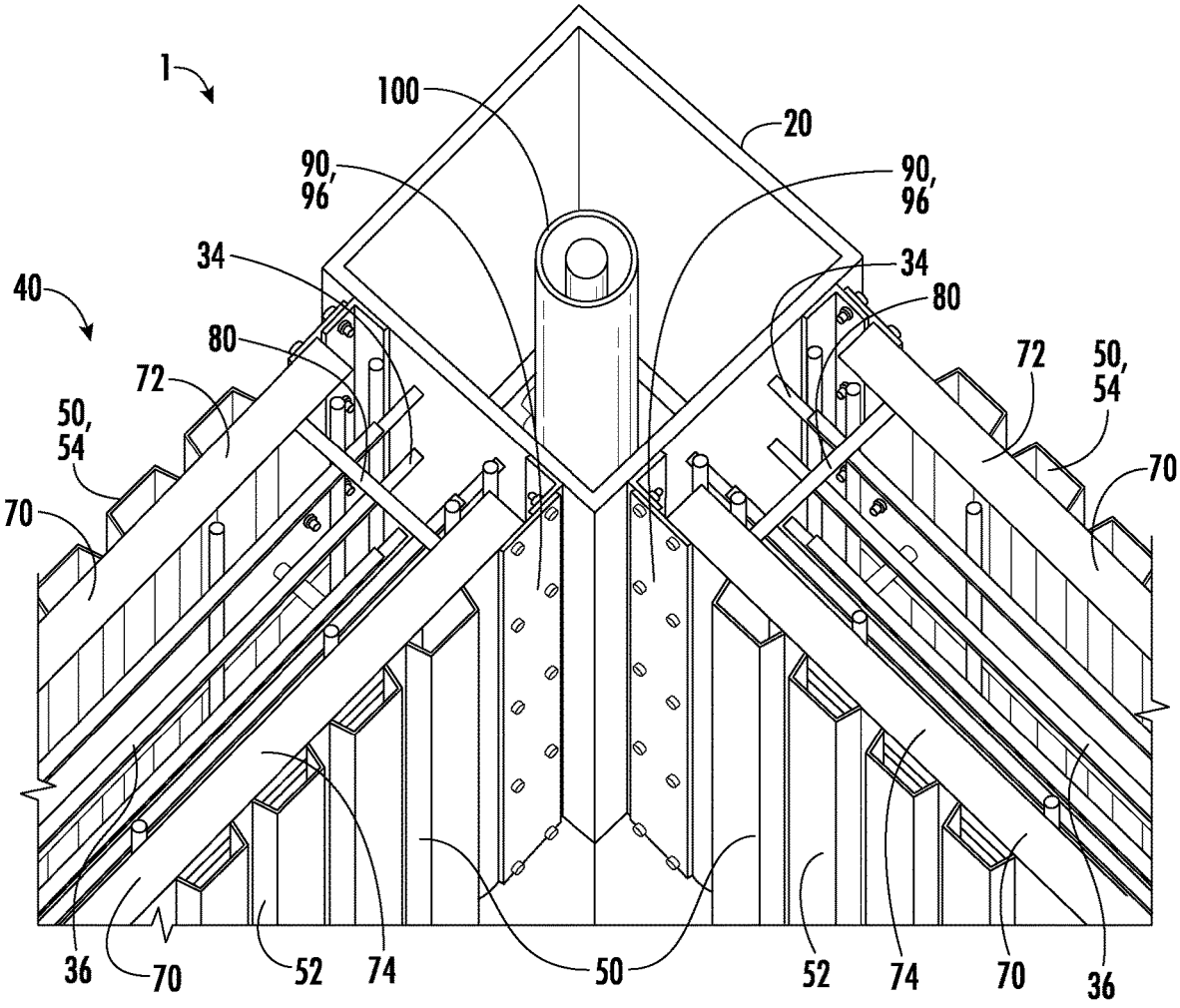
FIG. 2A illustrates a perspective view of hollow structural section members (HSS members) with two form walls, in accordance with embodiments of the present disclosure.
Figure 2B:
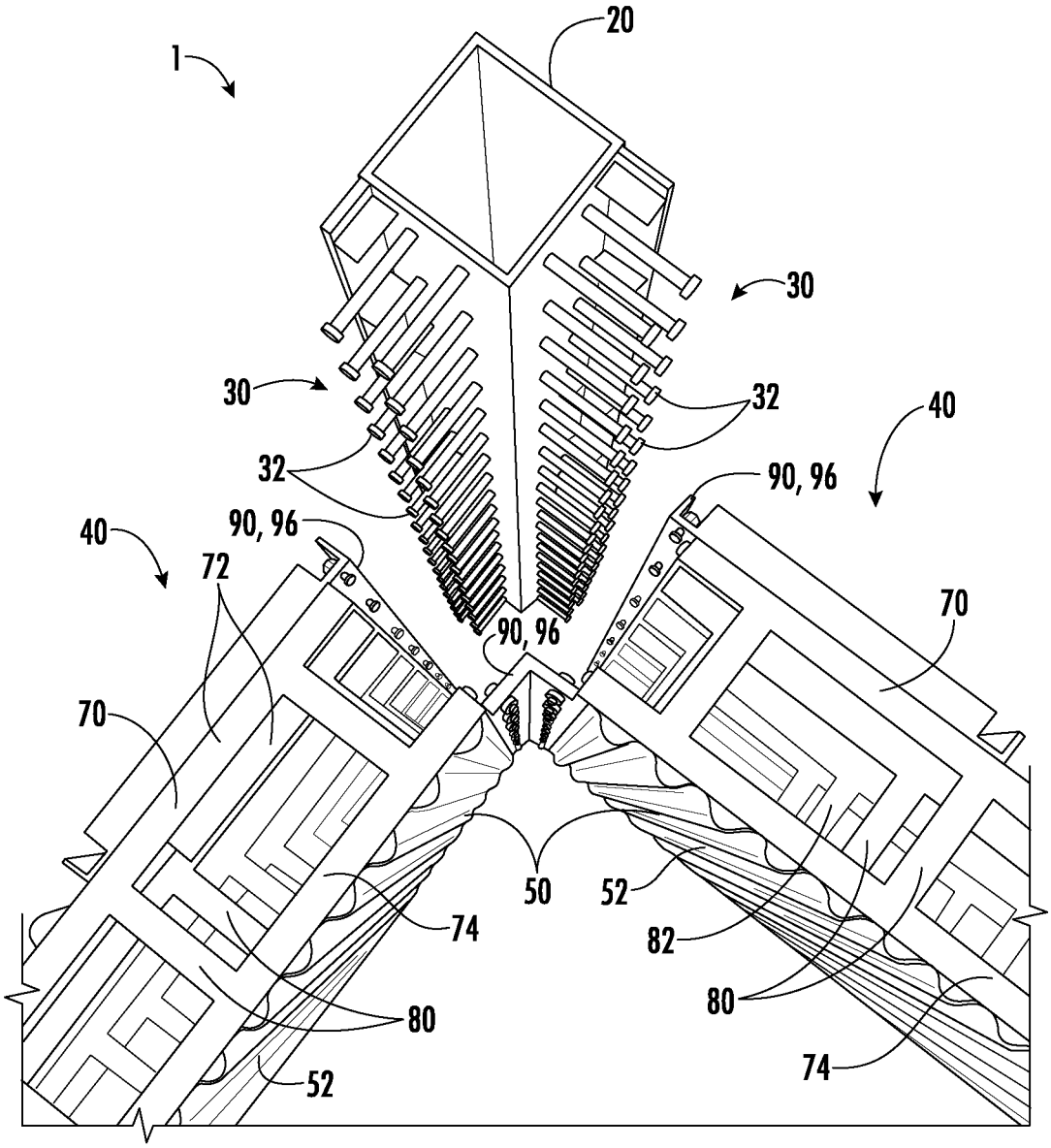
FIG. 2B illustrates an exploded perspective view of hollow structural section members (HSS members) having anchors and two form walls, in accordance with embodiments of the present disclosure.
Figure 3A:
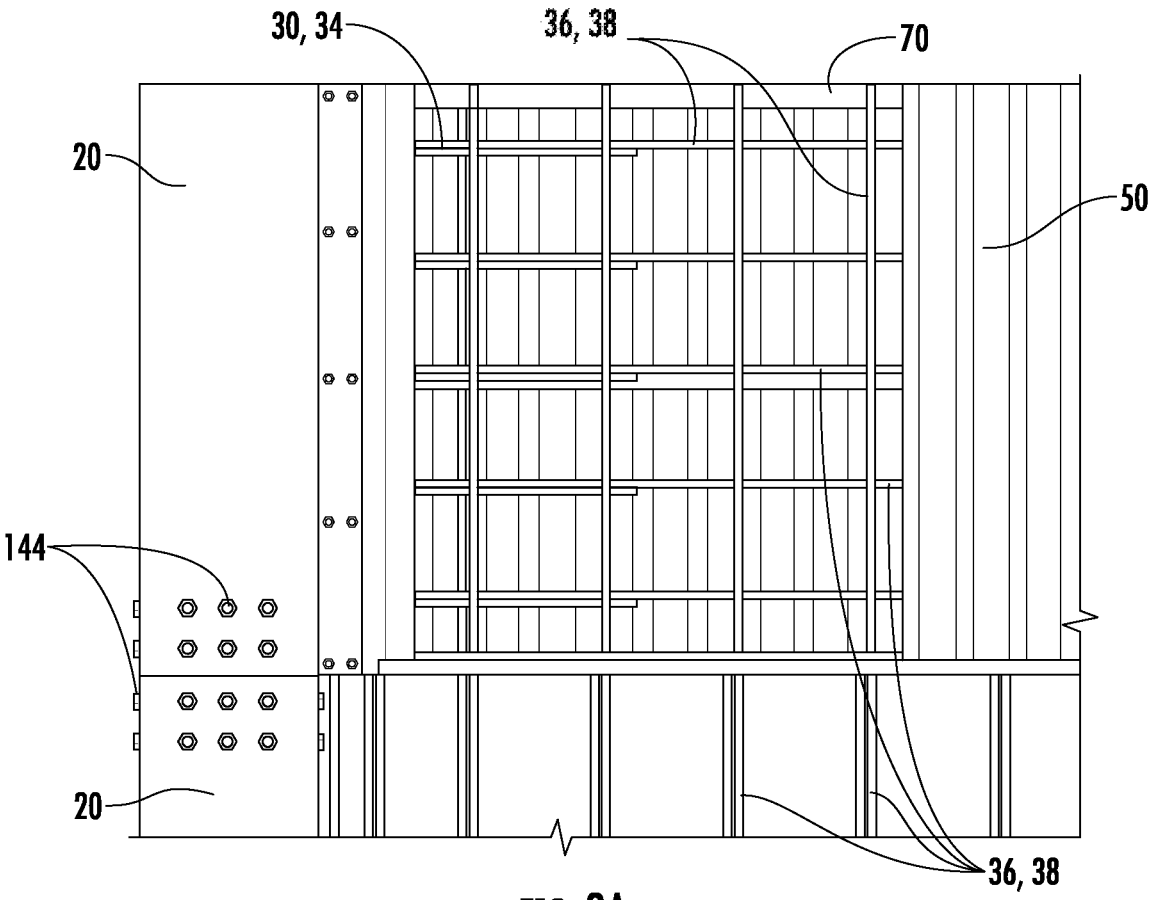
FIG. 3A illustrates an enlarged side view of a portion of the interfaces between two modules operatively coupled and with a portion of the panels of the form wall removed, in accordance with embodiments of the present disclosure.
Figure 3B:
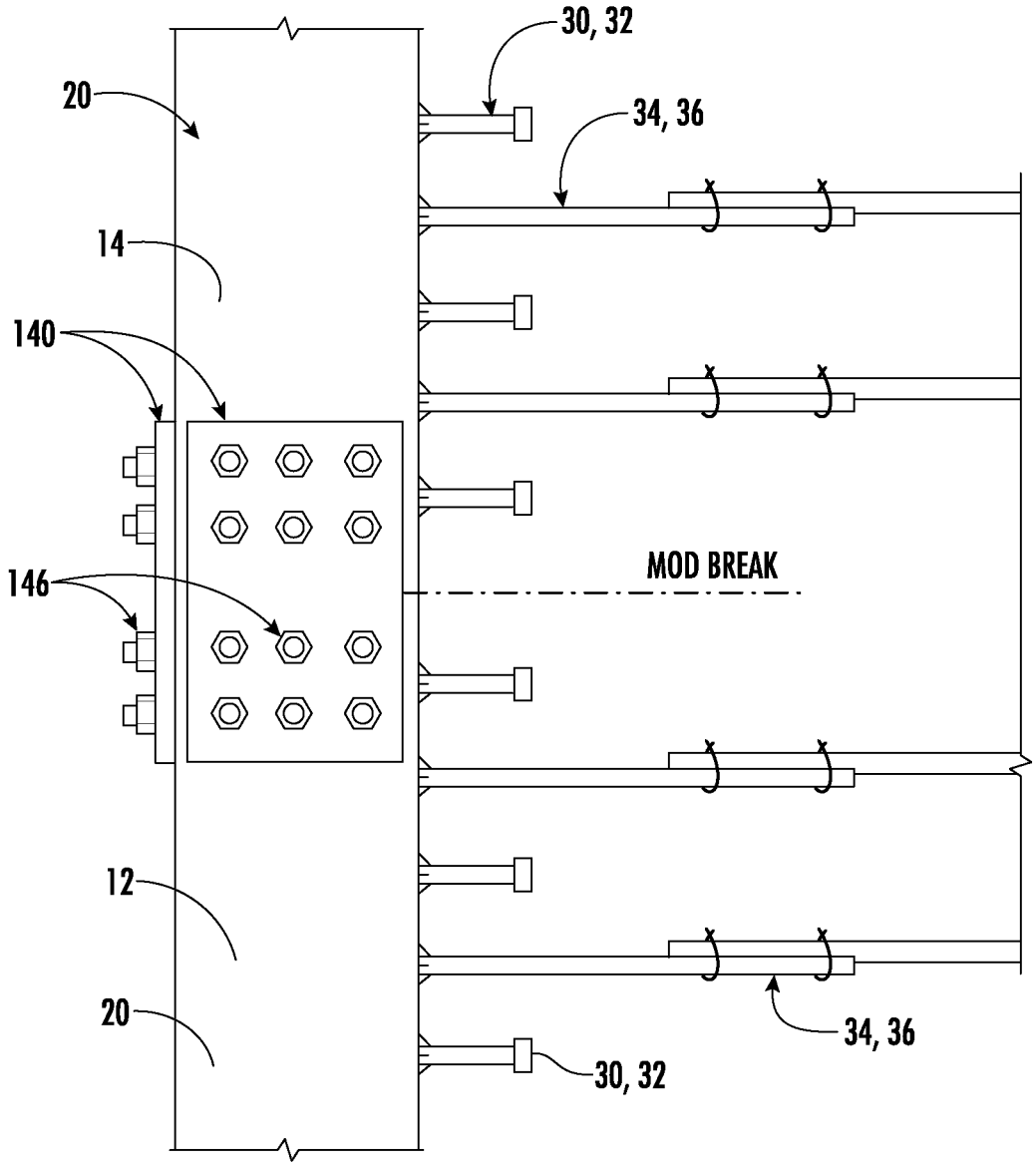
FIG. 3B illustrates an enlarged side view of two modules operatively coupled with HSS couplers and with the panels of the form wall removed, in accordance with embodiments of the present disclosure.
Figure 4A:
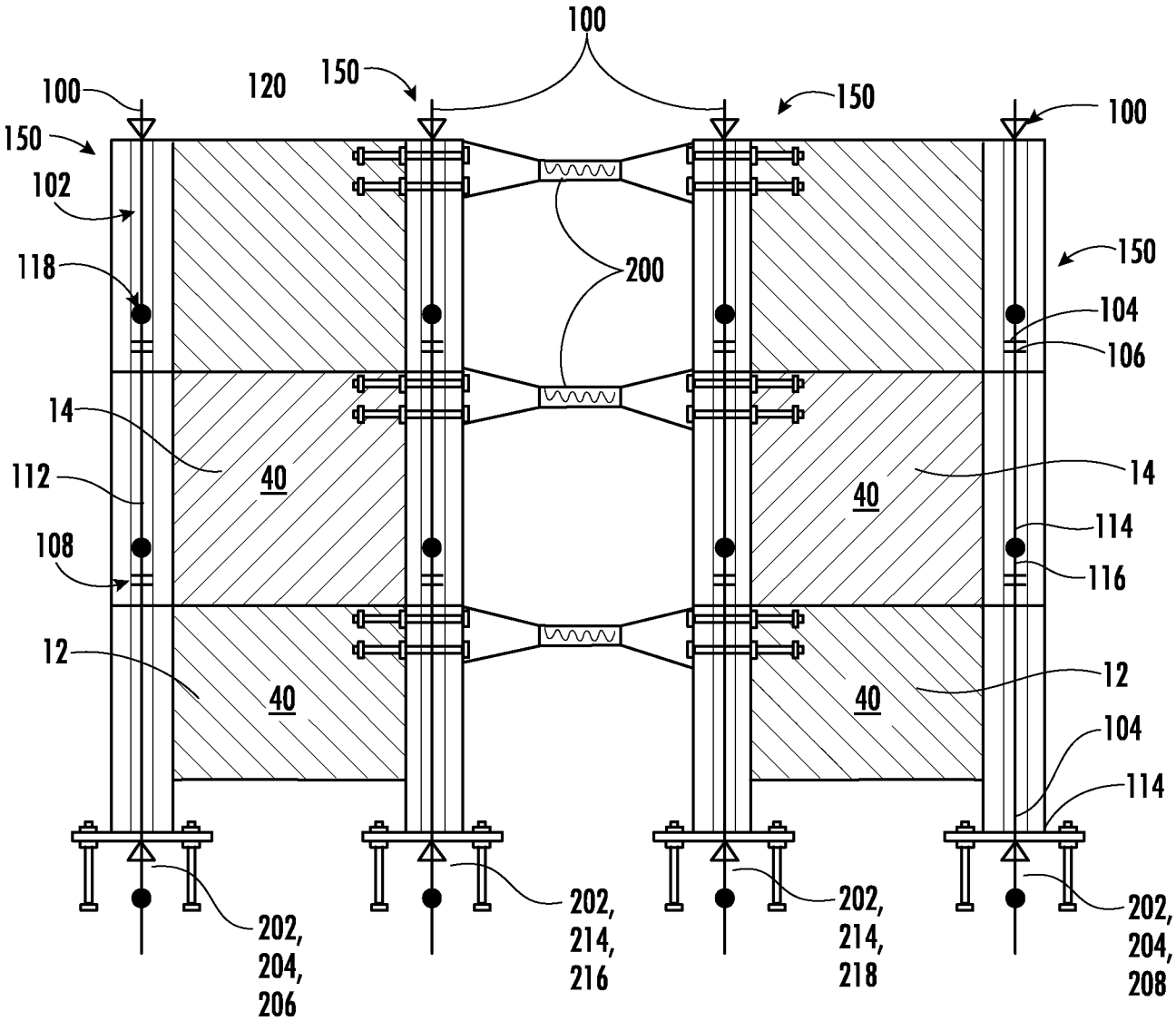
FIG. 4A illustrates a side cross-sectional view of three post-tensioned shear modules operatively coupled and having energy dissipation devices located within at least one form wall and between the modules and a foundation, in accordance with embodiments of the present disclosure.
Figure 4B:
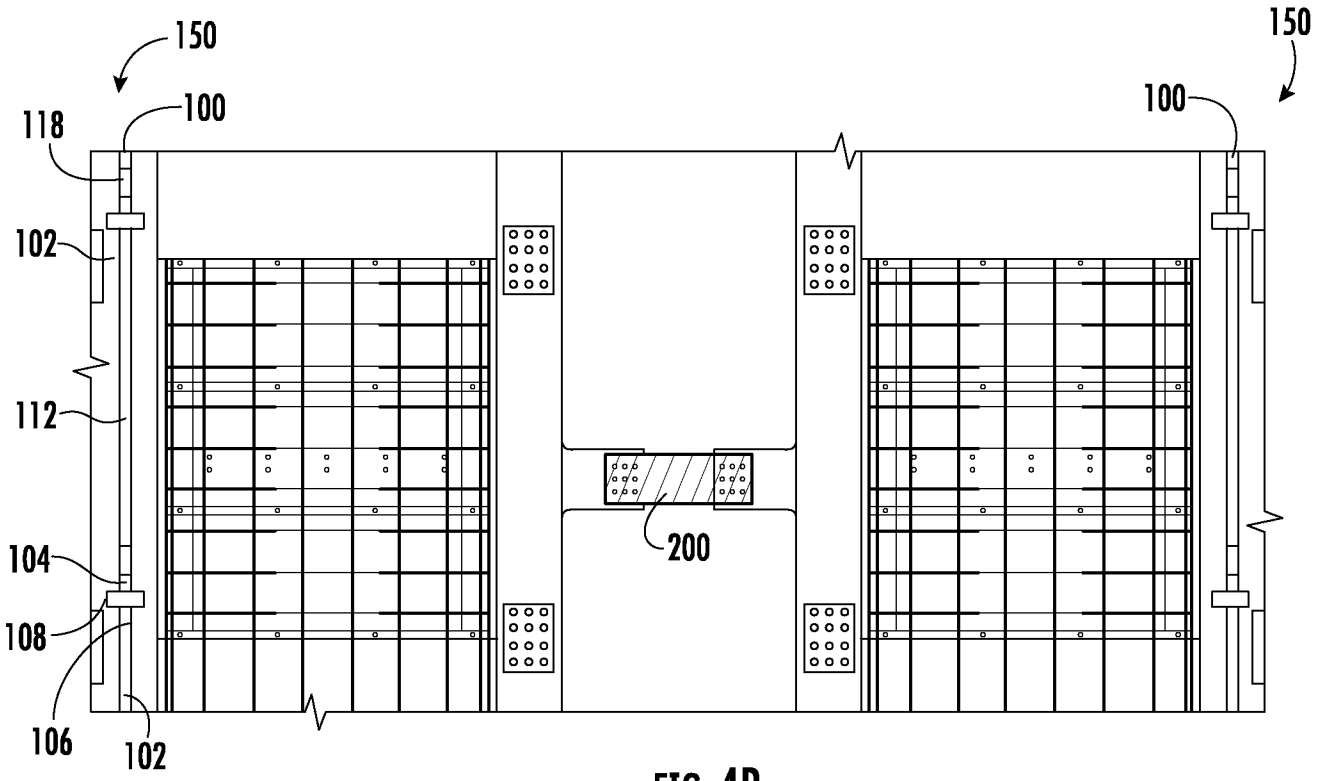
FIG. 4B illustrates a side cross-section view of a portion of three post-tensioned shear modules operatively coupled and having energy dissipation devices located within at least one form wall, in accordance with embodiments of the present disclosure.
Figure 5A:
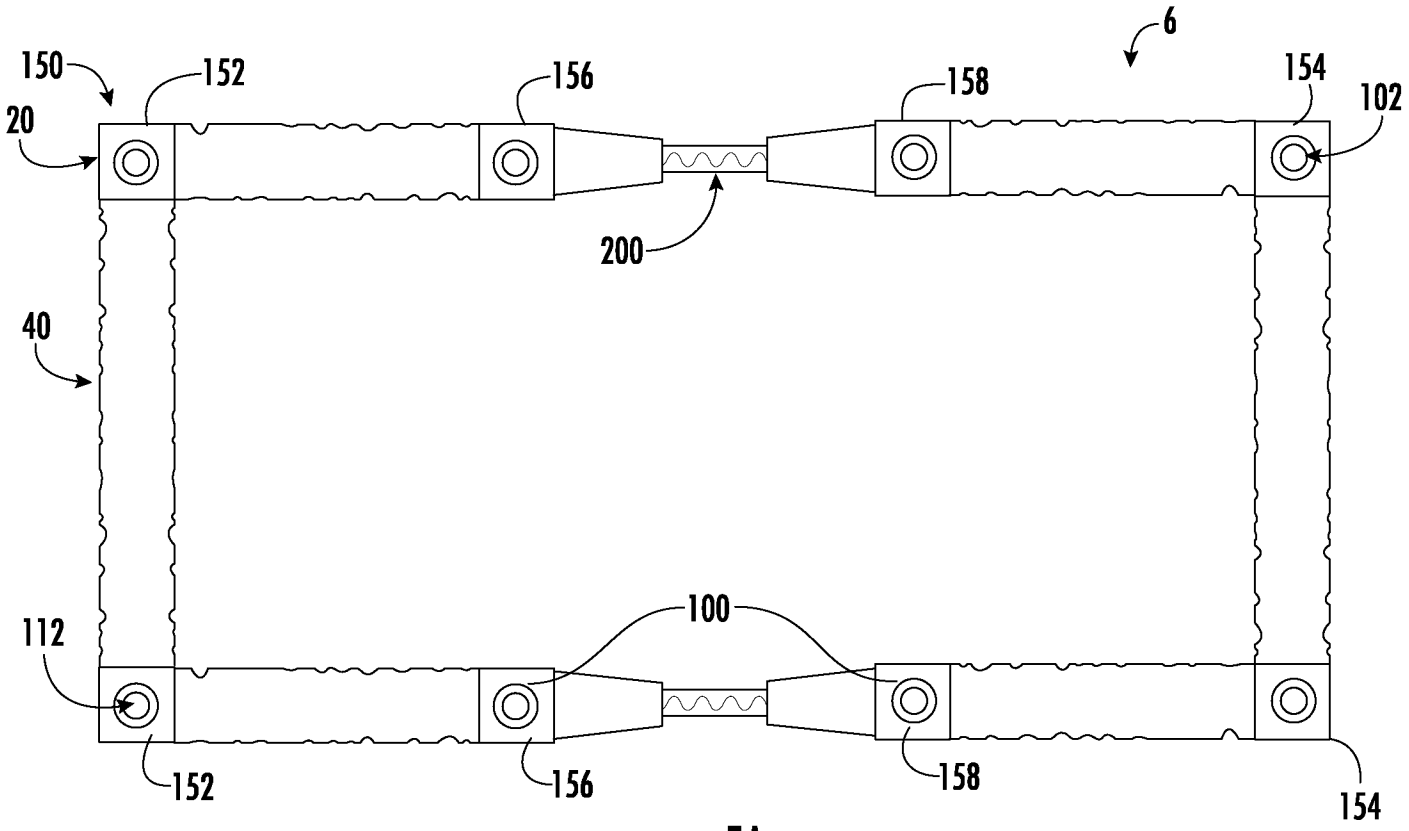
FIG. 5A illustrates a top view of the post-tensioned shear system, in accordance with embodiments of the present disclosure.
Figure 5B:
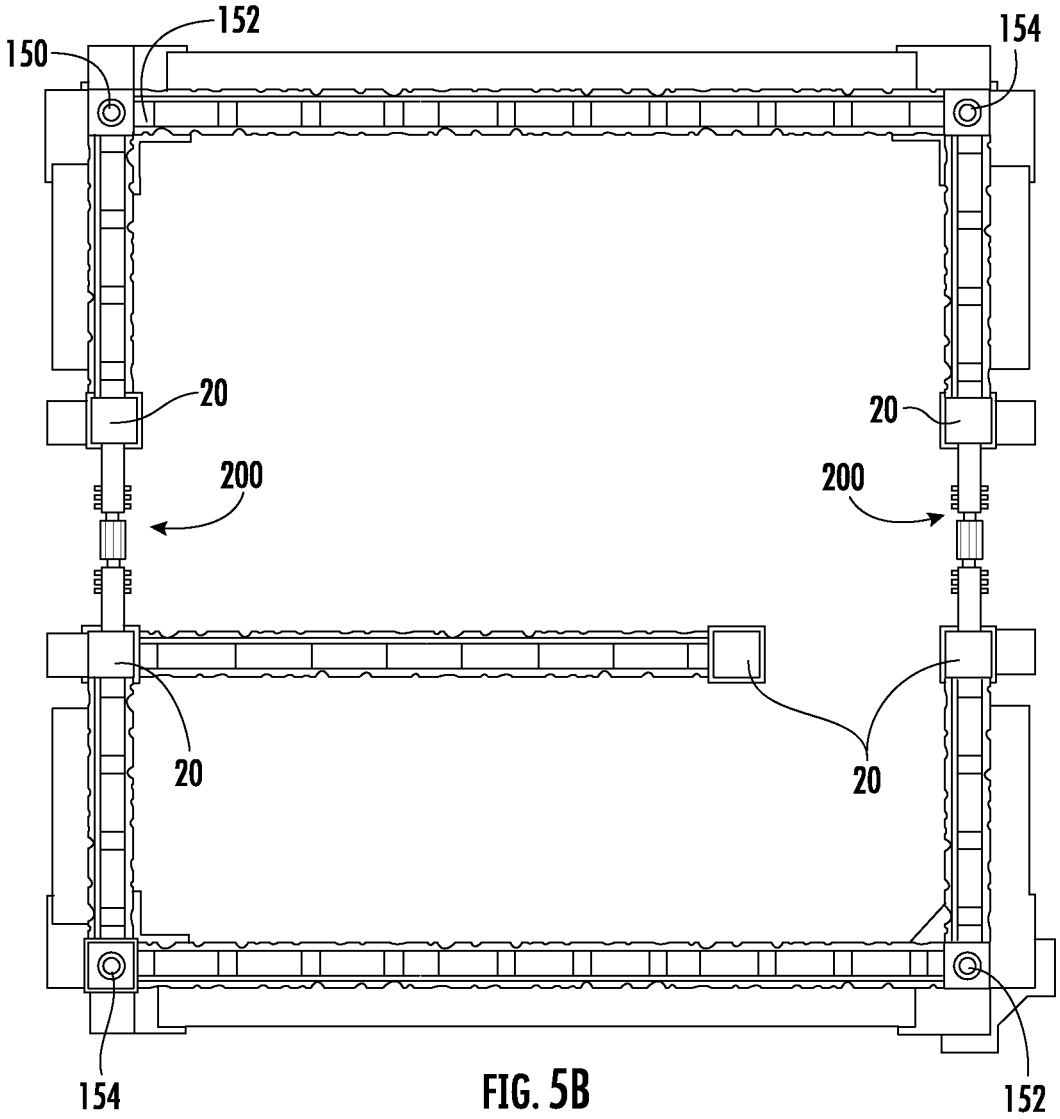
FIG. 5B illustrates a top view of the post-tensioned shear system for adjacent elevator and stair shafts, in accordance with embodiments of the present disclosure.

As illustrated in FIGS. 2A and 2B, the plurality of HSS members 20 may comprise of any hollow (e.g., completely enclosed, partially enclosed, or the like) member of any shape. For example, the HSS members 20 may be square, rectangular, circular, oval, triangular, pentagonal, hexagonal, heptagonal, octagonal, any other polygonal, uniform, non-uniform, or the like shape. In some embodiments, the HSS members 20 may be operatively coupled to the form wall 40 and/or lattice members 36 (e.g., rebar, other lattice members, or the like) through a plurality of wall couplings members 30 (e.g., anchors, fasteners, lattice couplings, or the like) that are used to operatively couple the HSS member 20 to the form wall 40. As illustrated in FIGS. 2A and 3A, in some embodiments couplings members may be lattice couplings 34 (e.g., rebar members) may be welded to the HSS members 20. Alternatively, as illustrated in FIGS. 2B and 3B, in some embodiments, the wall coupling members 30 may comprise a plurality of anchors 32 (e.g., studs, or the like). The coupling members 30 (e.g., anchors 32, lattice couplings 34, or the like) may be used for operative coupling with lattice members 36 (e.g., rebar, or other structural lattice members) within the form wall 40, form wall fill material 42 (e.g., concrete, liquid that hardens, or the like fill material) within the form wall 40, and/or other components within the form wall 40 (e.g., support members). However, it should be understood that in some embodiments the lattice members 36 may be operatively coupled to the HSS members 20 directly through a connection (e.g., welding, or the like) without the need for the coupling members 30.

With respect to the form wall 40, as illustrated in FIGS. 2A and 2B, one or more longitudinal wall members 70 may run along at least a portion of the form wall 40, generally the length of the form wall 40, or the like of the form wall 40. The longitudinal wall members 70 may comprise one or more external longitudinal wall members 72 and/or one or more internal longitudinal wall members 74. The longitudinal wall members 70 may be of any type of shape, such as L-shaped longitudinal members 76 (e.g., otherwise described as angle members, as illustrated), solid or hollow bar members (e.g., square, circular, oval, or the like), such as rebar, I-beam, H-beam, uniform or non-uniform longitudinal wall members, or the like. In some embodiments, the longitudinal wall members 70 may or may not have cut-outs in order to reduce the weight of the system, or the like.

The one or more transverse wall members 80 may run transverse to the length of the form wall 40 (e.g., across the thickness of the form wall 40, or the like). For example, the one or more transverse wall members 80 may be operatively coupled to and extend between the one or more external longitudinal wall members 72 and the one or more internal longitudinal wall members 74. Similar to the one or more longitudinal wall members 70, the one or more transverse wall members 80 may be of any type of shape, such as L-shaped transverse members 82 (e.g., otherwise described as angle members, as illustrated), solid or hollow bar members, such as rebar, I-beam, H-beam, uniform or non-uniform transverse wall members, or the like. In some embodiments, the transverse wall members 80 may or may not have cut-outs in order to reduce weight of the system, or the like.

The one or more vertical members 90 may be used to operatively couple the form wall 40 to the one or more HSS members 20 and/or to one or more adjacent form walls 40, for example as illustrated in FIGS. 2A and 2B. For example, the one or more vertical wall members 90 may be operatively coupled to and extend between the one or more longitudinal wall members 70 and the one or more HSS members 20. Similar to the one or more longitudinal wall members 70, the one or more vertical members 90 may be of any type of shape, such as L-shaped vertical members 96 (e.g., otherwise described as angle members, as illustrated), plates, solid or hollow bar members, such as rebar, I-beam, H-beam, uniform or non-uniform vertical wall members, or the like.

It should be understood that different combinations of longitudinal wall members 70, transverse wall members 80, vertical wall members 90, and/or lattice members 36 may be utilized, such as L-shaped longitudinal, transverse, and/or vertical members 76, 82, 96 and/or horizontal and/or vertical lattice members 36, as illustrated in FIG. 2A, and as will be described in further detail below.

The one or more longitudinal wall members 70, the one or more transverse wall members 80, and/or the one or more vertical wall members 90 may form the structure to which the one or more panels 50 are operatively coupled in order to create the form wall 40. As illustrated in FIGS. 2A, 2B, 8A and 8B, the one or more panels 50 of the form wall 40 may comprise one or more inner panels 52 and one or more outer panels 54. The one or more panels 50 may be fluted panels 60 comprising top flanges 62 (otherwise described as longitudinal peaks or top flute portions) and bottom flanges 64 (otherwise described as longitudinal troughs or bottom flute portions). The top flanges 62 and the bottom flanges 64 are operatively coupled together through the use of a webs 66 (e.g., members that are perpendicular or sloped inwardly or outwardly with respect to the flanges). A flute is defined as a top flange 62, the webs 66 on both sides of the top flange 62, and a half of the bottom flanges 64 extending from the webs 66 on both sides of the top flange 62 or a full bottom flange 64 extending from one of the webs 66 on one side of the top flange 62. Multiple flutes form the profile of the fluted panel 60.

The profiles of the fluted panels 60 may be referred to as "fluted profiles," such as "hat profiles", "flat-bottomed profiles", "dovetail profiles", "triangular profiles," "trapezoidal profiles," or other like profiles. The distance from the top of the top flange 62 and the bottom of the bottom flange 64 may generally range from 1½ inches to 4 inches in depth; however, other ranges of depths within this range, overlapping this range, or outside of this range may be used in the profiles. For example, in some embodiments, the distance may range from less than 1 inch to 12 inches in depth, or the like. The panels 60 may or may not include longitudinal ribs, bends, or cutouts that provide the desired (e.g., intended, required, or the like) structural strength and/or stiffness to the fluted panels 60. Depending on the material thickness, the length and width of the fluted panels 60, and the height of the top flanges 62 and bottom flanges 64, the fluted panels 60 may weigh between 100 and 420 lbs. In other embodiments, the weight of the fluted panels 60 may be within, overlap, or be located outside of this range. Each fluted panel 60 may be formed (e.g., roll-formed, or the like) into the desired profile. Typically, the fluted panel 60 profile includes top flanges 62 and bottom flanges 64 of different shapes and sizes, which create the various types of profiles (e.g., hat profiles, vee profiles, triangular profiles, dovetail profiles, or any other type of panel profile). The top flanges 62 and bottom flanges 64 provide the desired strength and/or stiffness of the fluted panels 60.

While the one or more panels 50 are illustrated as fluted panels 60, it should be understood that the one or more panels 50 may be made of any type of material (e.g., metal, wood, plastic, composite, or other material), and may be flat, fluted (e.g., with any type of profile as described herein), or have any size or shape. Moreover, the panels 50 may be permanent or removeable from the post-tensioned shear system 1 described herein, such that after fill material is poured into the form wall 40, the one or more panels 50 may remain in place, or may be removable.

As previously discussed above, as illustrated in FIGS. 2A through 3B, the one or more form walls 40 may further comprise one or more lattice members 36 (e.g., rebar members 38, other bar members, L-shaped members, or other like members) located between the one or more panels 50 of the form wall 40. For example, the one or more lattice members 36 (e.g., rebar members 38, or the like) may be operatively coupled to the form wall 40 through any type of connection, with or without coupling members 30, such as the plurality of anchor members 32, the lattice couplings 34, or the like). For example, in some embodiments, rebar members 38 are operatively coupled to the HSS members 20 directly through welding, or indirectly through anchor members 32 or lattice couplings 34, and extend laterally between the HSS members 20 within a form wall 40 to provide additional support within the form wall 40. The lattice members 36 (e.g., the rebar members 38) may extend generally horizontally between the HSS members 20 and/or generally vertically between the one or more wall panels 50. However, the lattice members 36 may be oriented any orientation within the one or more wall panels 50. Moreover, it should be understood that the lattice members 36 may be assembled before installing a modular section 10 within the modular post-tensioned shear system 1. However, it should be understood that the lattice members 36, in particular the vertical lattice members 36, may be installed after one or more modular sections 10 are installed. In particular, the vertical lattice members 36 may be inserted between the one or more panels 50 of the form wall 40 between two or more stacked modular sections 10. In some embodiments, by extending the vertical lattice members 36 between two or more stacked modular sections 10, the lattice members 36 may improve the structural integrity of the modular post-tensioned shear system 1 (e.g., after the fill material, such as the cementing material, or other like material is poured) since adjacent modular sections 10 would have additional structural ties.

As will be described in further detail herein, after the modular sections 10 are installed, the one or more form walls 40 may or may not include form wall fill material 42 (e.g., cementitious material, concrete, fluid that hardens, fluid that expands, or the like). For example, as will be described with respect to the method of installing the modular post-tensioned shear system 1, after one or more modular sections 10 (e.g., after each modular section 10, or after two or more modular sections 10) are installed, the form wall 40 may be filled with the form wall fill material 42, such as a cementitious material, concrete, fiber reinforced material, or other structural material. In some embodiments, the fill material 42 may be structural fill material that provides structural support to the modular post-tensioned shear system 1. Additionally, or alternatively, the fill material 42 may provide other benefits, such as fire resistance, insulation, air flow reduction, or other like benefits. While the fill material 42 may be inserted into each modular section 10 when it is assembled to the modular post-tensioned shear system 1, it should be understood that two or more modular sections 10 may be assembled before the fill material 42 is inserted into the two or more modular sections 10. It should be further understood that while the fill material 42 is described as being poured into the form wall 40, and later hardens, in some embodiments the fill material 42 may already be solid and installed as the form wall 40 as it is being formed. In other embodiments, the fill material 42 may be a liquid that hardens during assembly of the form wall 40 before it is installed within the modular post-tensioned shear system 1. Finally, in other embodiments, depending on the requirements for loading (e.g., cyclic loading) and/or other benefits, the modular sections 10 may be assembled without the use of form wall fill material 42, and as such may remain open.

As illustrated in FIGS. 4A through 8B, the HSS members 20 may include a post-tensioning assembly 100, which when combined within the HSS members 20 in a plurality of stacked modular sections 10 form an HSS post-tensioned system 150. The post tensioning assembly 100 may comprise a conduit member 102 having a distal conduit end 104, a proximal conduit end 106, and a conduit end coupling 108 to operatively couple a distal conduit end 104 of one conduit member 102 to a proximal conduit end 106 of another conduit member 102. While the conduit members 102 are illustrated as separate conduit members 102 within each modular section 10, it should be understood that each modular section 10 may have multiple conduit members 102, multiple modular sections 10 may have a single conduit member 102, or the like. The conduit members 102, like the HSS members 20, may be any size or shape (e.g., square, rectangular, circular, oval, triangular, pentagonal, hexagonal, heptagonal, octagonal, any other polygonal, uniform, non-uniform, or the like shape); however, in the embodiments illustrated in the figures, the conduit member 102 is a hollow cylindrical member.

As illustrated in FIGS. 4A, 4B, and 6A through 6D, the post-tensioning assembly 100 may further comprise a tensioning member 112 having a distal tensioning end 114 and a proximal tensioning end 116, and a tensioning end coupling 118 to operatively couple a distal tensioning end 114 of one tensioning member 112 to a proximal tensioning end 116 of another tensioning member 112. While the tensioning members 112 are illustrated as separate tensioning members 112 within each modular section 10, it should be understood that each modular section 10 may have multiple tensioning members 112, multiple modular sections 10 may have a single tensioning member 112, or the like. The tensioning members 112 are illustrated as being threaded rebar members 110. It should be understood that the threaded rebar members 110 may be rolled such that the ends of the threads of the rebar include threaded ribs rolled into the rebar (e.g., with or without having to machine longitudinal ribs along the length of the rebar). In other embodiments the rebar may be standard rebar (e.g., with standard rebar patterns rolled into the rebar) and with machined threaded ends. Alternatively, the tensioning members 112 may be standard rebar with different threads. The tensioning end coupling 118 may comprise a nut, two mating halves, or the like into which the distal tensioning end 114 and/or the proximal tensioning end 116 may be operatively coupled. In still other embodiments, the tensioning members 112 may comprise cable members (e.g., twisted wire cables, or the like) that are operatively coupled together using the tensioning end coupling 118 (e.g., extends around the braids of the cables, or the like). While the tensioning members 112 are described as rebar or cables, it should be understood that the tensioning members 112 may be any type of members that may be operatively coupled using any type of tensioning end couplings 118.

As further illustrated in FIGS. 4A, 4B, and 6A through 6D, in some embodiments, the proximal conduit end 104 of the conduit member 102 extends past the HSS member 20; however, it should be understood that the proximal conduit end 106 may be in the same plane as the end of the HSS member 20, or may be located inside of the HSS member 20. Moreover, as illustrated in the figures the proximal tensioning end 116 may extend past the proximal conduit end 104 and/or the end of the HSS member 20; however, it should be understood that the proximal tensioning end 116 may be in the same plane as the proximal conduit end 106 and/or the end of the HSS member 20, may be located in the same plane as the proximal conduit end 106 and/or the end of the HSS member 20, or may be located inside of the proximal conduit end 106 and/or the end of the HSS member 20. However, in the illustrated embodiments it may be beneficial to connect additional members when the proximal conduit end 106 extends past the end of the HSS member 20, and the proximal tensioning end 116 extends past both the end of the HSS member 20 and the proximal conduit end 106.

As discussed above, it should be understood that the conduit member coupling 108 and the tensioning member coupling 118 may be any type of coupling member. For example, the conduit member coupling 108 may be a weld, a straight end inserted into a flared end, a crimped end inserted into a straight end, a crimped end inserted into a flared end, two ends that are bubble punched, fasteners (e.g., clips, bolts, screws, rivets, or the like) operatively coupling two ends, a connector that extends around two ends, male and female threads, on opposite ends of adjacent conduit members 102, an adhesive (e.g., glue, or other liquid that hardens into a solid) to bond two coupling ends, a collar and/or protrusion, brackets, clamps, and/or any other coupling 108 that operatively couples two ends 104, 106 of adjacent conduit members 102.

With respect to the tensioning member 112, the tensioning coupling 118 may comprise a tensioning connector with internal threads that is screwed around a proximal tensioning end 116 of a tensioning member 112 and a distal tensioning end 114 of an adjacent tensioning member 112 is screwed into the other end of the tensioning connector. In other embodiments the tensioning connector may comprise two or more parts (e.g., crescent shaped, or the like) that extend around the two tensioning ends 114, 116 and are fastened together. In other embodiments, like the conduit coupling 108, the tensioning couplings 118 may comprise a weld, a straight end inserted into a flared end, a crimped end inserted into a straight end, a crimped end inserted into a flared end, two ends that are bubble punched, fasteners (e.g., clips, bolts, screws, rivets, or the like) operatively two ends together, a collar and/or protrusion, brackets, clamps, and/or any other couplings 118 that operatively couple two ends 114, 116 of adjacent tensioning members 112.

As will be described in further detail with respect to the assembly process in FIG. 13 and FIGS. 14A through 14I, the conduit members 102 and the tensioning members 112 are operatively coupled to adjacent conduit members 102 and tensioning members 112 extending from the last installed modular section 10 before the next modular section 10 is placed over (e.g., using a crane, or the like) the one or more conduit members 102 and/or the one or more tensioning members 112. In alternate embodiments, the tensioning member 112 may be one or more tensioning cables (e.g., a single cable, multiple cables coupled together, or the like). In some embodiments, the one or more tensioning cables may be extended through (e.g., dropped through, or the like) the one or more conduit members 102 within the HSS members 20. In this configuration, the one or more tensioning cables maybe flexible until it is extended through the conduit members 102 and operatively coupled to a base module (or foundation) and/or the last module section 10 within the post-tensioned shear system 1.

As further illustrated in FIGS. 3A, 3B, 6C, and 8, once a modular section 10 is placed over the conduit members 102 and/or the tensioning members 112, one or more HSS couplers 140 are utilized to operatively coupled adjacent HSS members 20. The HSS couplers 140 may be any type of coupling member. In some embodiments, the HSS couplers 140 may be the same as or similar to the conduit couplers 108 and/or the tensioning couplers 118. For example, the HSS couplers 140 may comprise a weld, a straight end inserted into a flared end, a crimped end inserted into a straight end, a crimped end inserted into a flared end, two ends that are bubble punched, fasteners (e.g., clips, bolts, screws, rivets, or the like) operatively coupling two ends, a connector that extends around two ends, a collar and/or protrusion, brackets, any other coupling that operatively couples two ends of adjacent HSS members 140, and/or combinations of the forgoing.

In particular embodiments, the HSS couplers 140 may comprise one or more plate brackets 142, which may be located on outer surfaces (as illustrated in FIG. 3B), inner surfaces (as illustrated in FIG. 3A), and/or both outer and inner surfaces of the HSS members 20. In other embodiments, the HSS couplers 140 may include an L-shaped bracket (e.g., around an external corner, internal corner, or the like of the HSS members 20), or other shaped brackets. In still other embodiments, the one or more HSS couplers 140 may include a collar around an end of the HSS member 20 and/or a protrusion within the inner surface of an end of the HSS member 20. As such, an end of an HSS member 20 may be inserted into a collar of an end of another HSS member 20 and/or a protrusion of an end of an HSS member 20 may be inserted into an end of another HSS member 20. In other embodiments, the HSS couplers 140 may include welding the ends, the brackets, the collars, the protrusions, or other couplers 140 to each other and/or to the HSS member 20 surfaces. In other embodiments, the HSS couplers 140 may include one or more connectors, such as fasteners (e.g., bolts, anchors, nuts, or the like) that may be screwed through HSS couplers 140 (e.g., brackets) and/or to the HSS members 20, welds between the HSS couplers 140 or the HSS members 20, or the like. For example, in some embodiments, as illustrated in FIG. 3B bolt fasteners 144 may be welded to the HSS ends and/or extend through the HSS ends, the plate bracket 142 may have holes that allow the bolt fasteners 144 to extend through the plate bracket 142, and a nut fastener 146 may be coupled to the bolt fasteners 144 to secure the plate bracket 142 to the ends of adjacent HSS members 20. Alternatively, in some embodiments, as illustrated in FIGS. 3A and 6C, the nut fastener 146 may be welded internally within the HSS ends and/or to an internal plate bracket 142 located within the HS S ends, and may allow the bolt fastener to extend through the outer HSS surface through the plate bracket 142 and into the nut fastener 144.

Figure 6A:
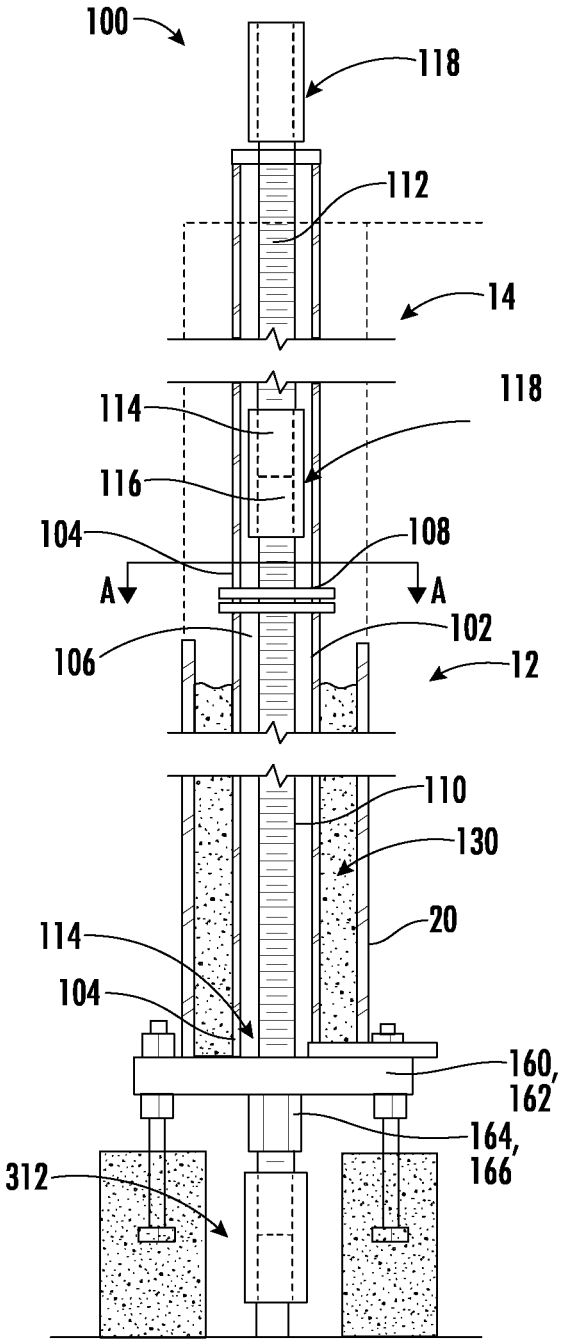
FIG. 6A illustrates a cross-sectional and split side view of an HSS post-tensioned system having conduit and tensioning members within an HSS member, in accordance with embodiments of the present disclosure.
Figure 6B:
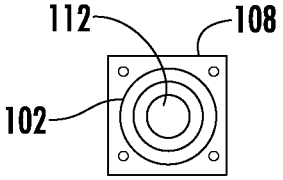
FIG. 6B illustrates a top view of a conduit coupling for coupling two conduits within the HSS post-tensioned system, in accordance with embodiments of the present disclosure.
Figure 6D:
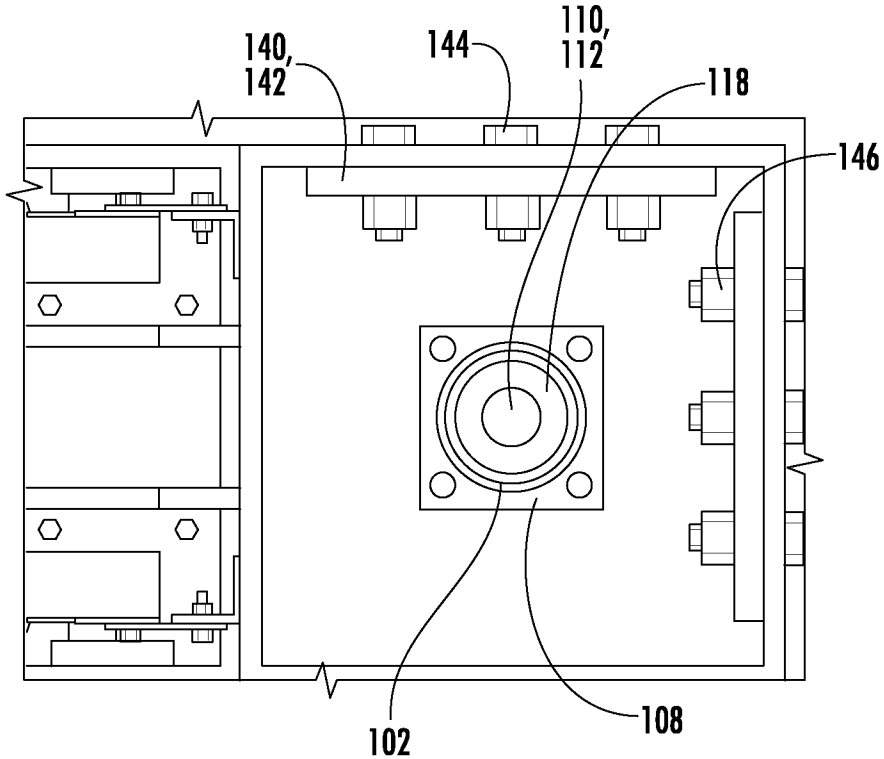
FIG. 6D illustrates a top view of an HSS post-tensioned system having conduit and tensioning members within an HSS member, in accordance with embodiments of the present disclosure.
Figure 6C:
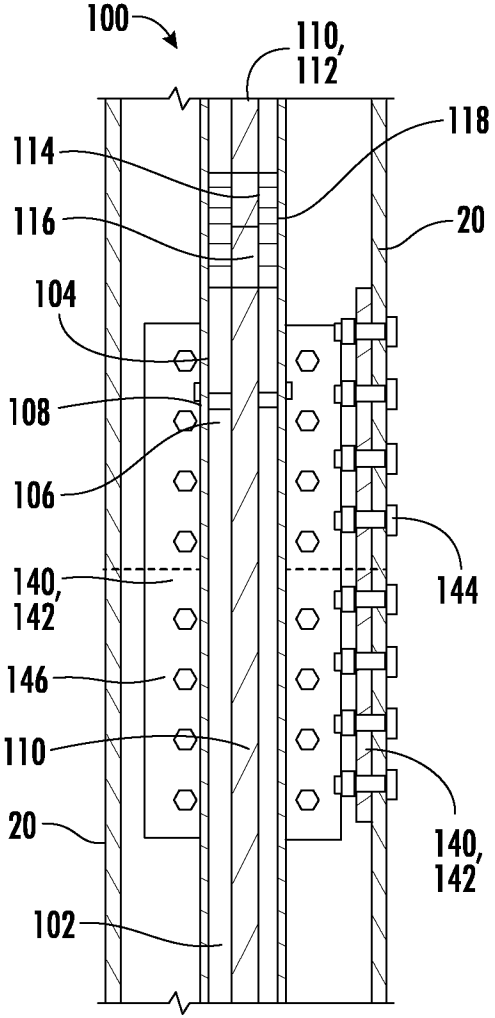
FIG. 6C illustrates a cross-sectional side view of an HSS post-tensioned system having conduit and tensioning members within an HSS member, in accordance with embodiments of the present disclosure.
Figure 6E:
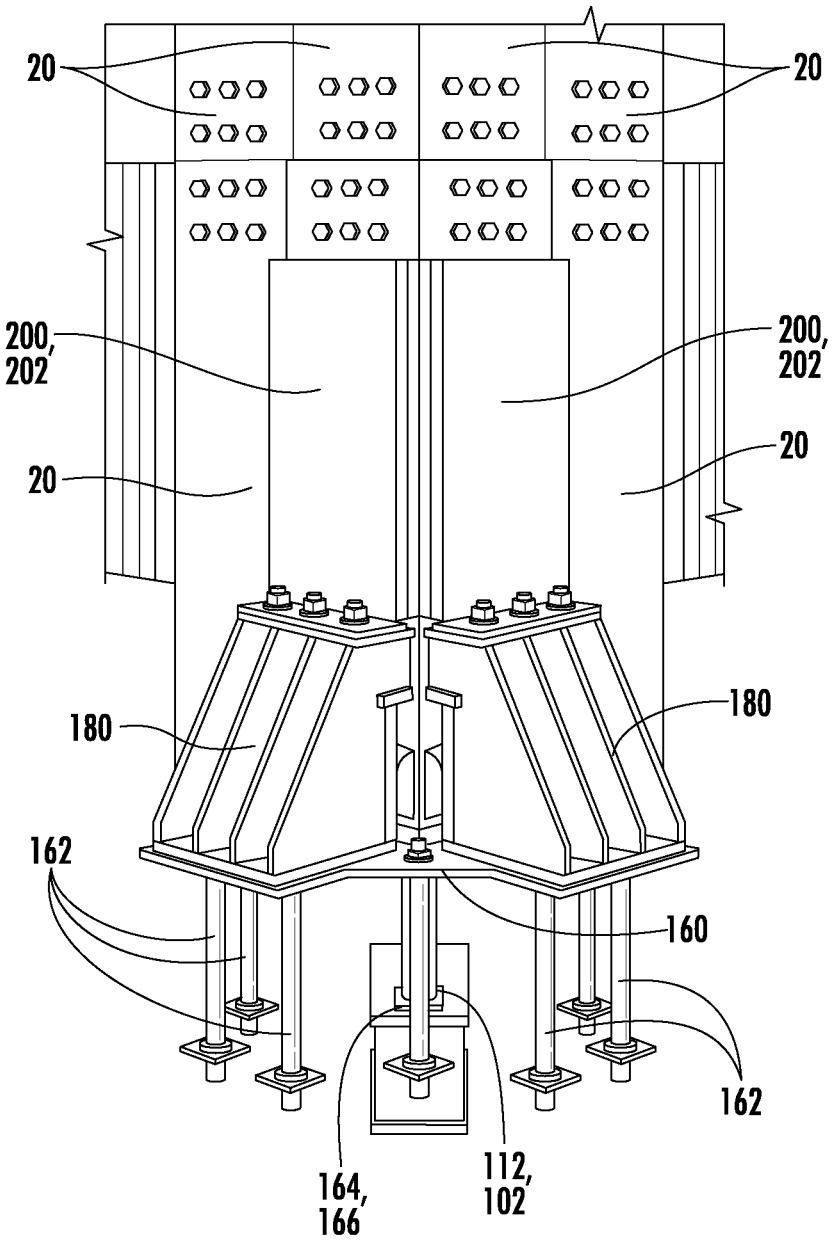
FIG. 6E illustrates a perspective view of a portion of corner of the base shear module having energy dissipation device(s), in accordance with embodiments of the present disclosure.

FIGS. 6A and/or 6E and 6F illustrate some embodiments in which the post-tensioning assemblies 100 may be operatively coupled to the base module 16, a foundation below the base module 16, and/or to the ground below the base module 16. Moreover, as illustrated in FIGS. 6E and 6D, the base module 16 may utilize one or more energy dissipation devices 200, such as base energy dissipation devices 202, as will be described in further detail herein with respect to FIGS. 10A through 12B. In some embodiments, as illustrated in FIG. 6A, the tensioning member 112 and/or conduit 102 may be operatively coupled to one or more foundation brackets 160 (e.g., a plate, H-shaped support with a pocket, I-shaped support with a pocket, combinations thereof, or the like), which is located within the base module 16, a foundation below the base module 16, and/or in the ground below the base module 16. Moreover, the foundation bracket 160 (e.g., a foundation plate bracket 164) may be operatively coupled to foundation supports 170 (e.g., piles, beams, composite supports, cages with cement, anchor bolts, anchor plates, or the like, or combinations thereof) through the use of using fastener(s) 162 (e.g., anchors, bolts, nuts, or the like). In some embodiments, the tensioning member 112 is operatively coupled to a plate bracket 164 through the use of a nut 166. In some embodiments the nut 166 may be accessed through the pocket (e.g., a steel pocket, or the like) formed by or within the foundation bracket 160 that allows for access to the nut 166 (e.g., nut, or the like) for engagement, adjustment, or disengagement of the tensioning member 112 at the base module 16 and/or foundation.

Figure 6F:
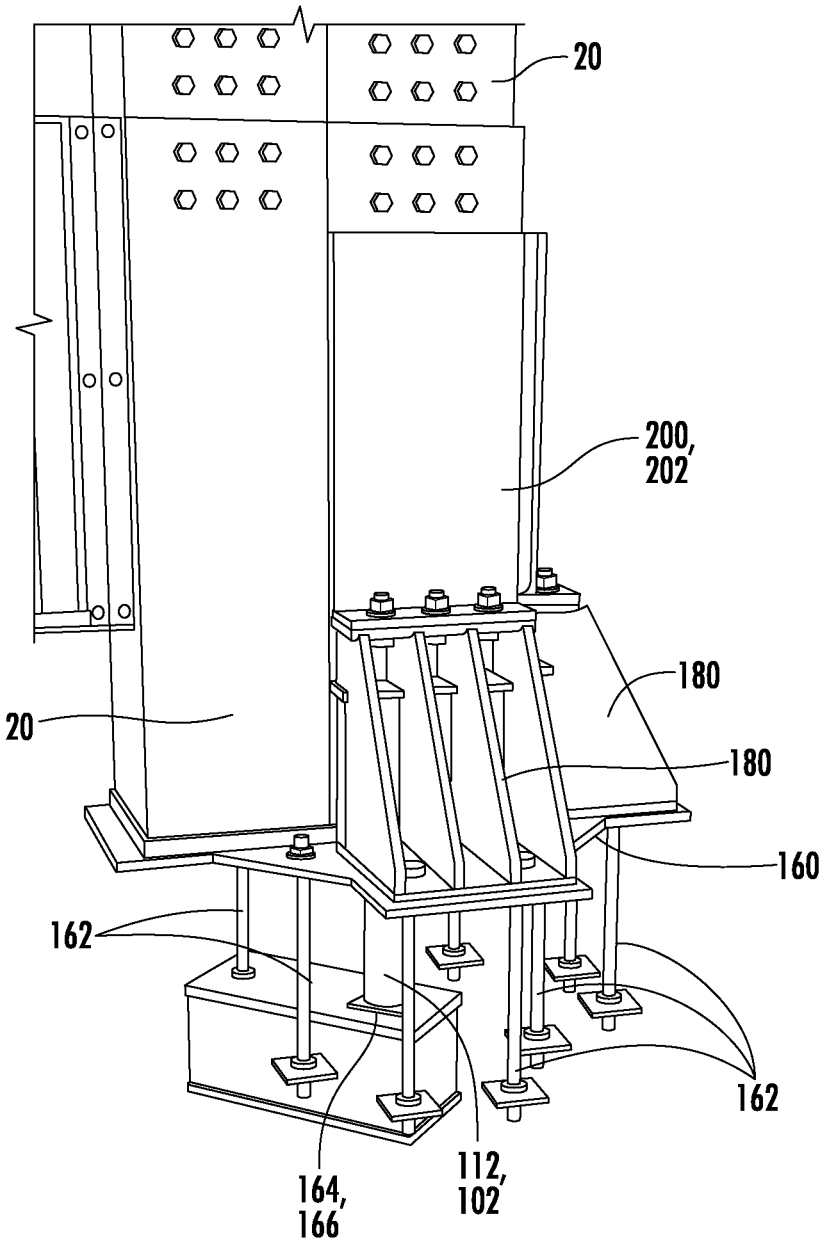
FIG. 6F illustrates a perspective view of a portion of corner of the base shear module having energy dissipation device(s), in accordance with embodiments of the present disclosure.

In other embodiments, as illustrated in FIGS. 6E and 6F, the base module 16 may utilize one or more base support members 180 that are operatively coupled to the foundation bracket 160 and/or the HSS members 20 directly or through the use of one or more base energy dissipation devices 202, as will be described in further detail with respect to FIGS. 10A through 12B.

Figure 7A:
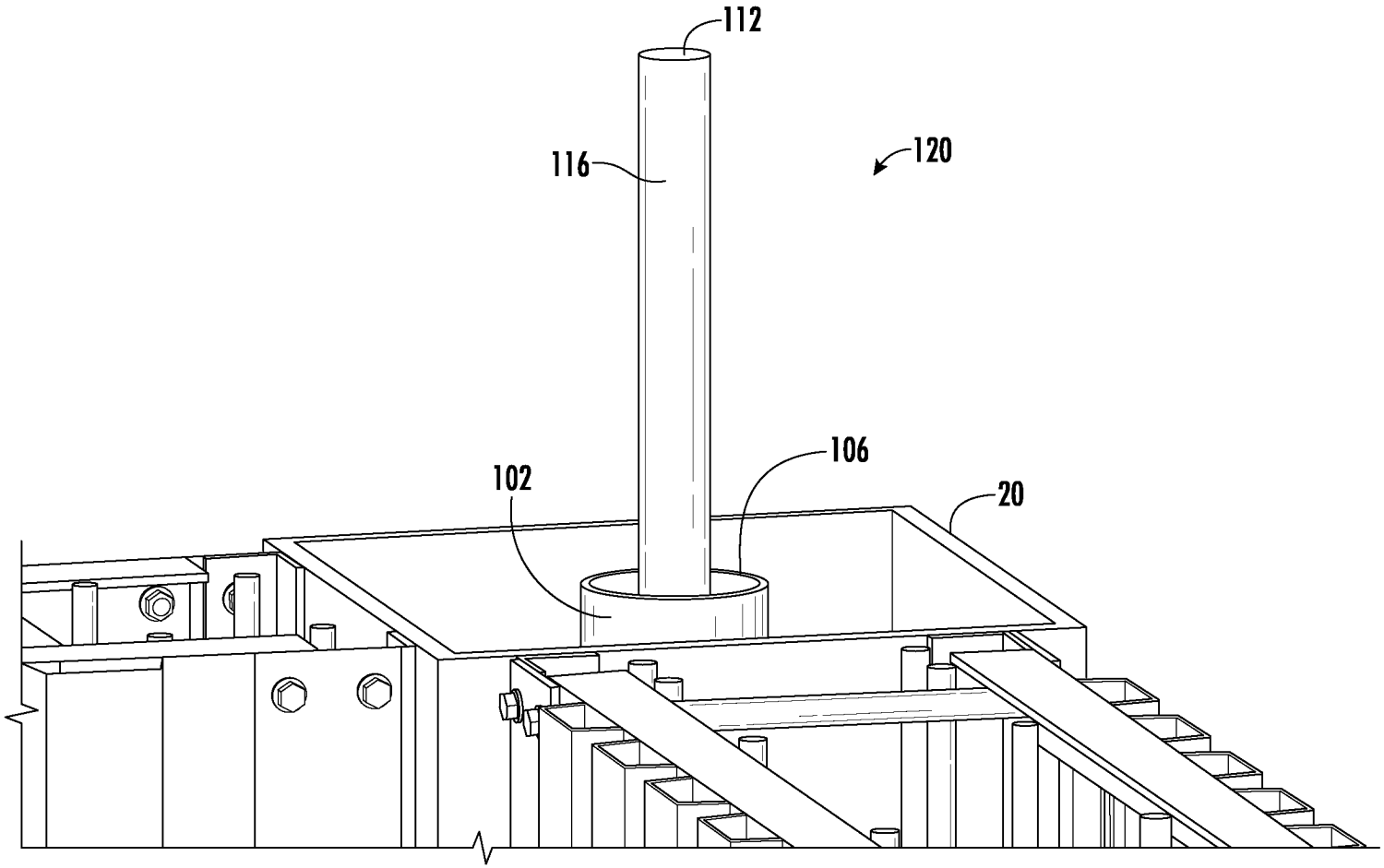
FIG. 7A illustrates an enlarged perspective view of the upper end of the HSS post-tensioned system that provides the post-tensioning, in accordance with embodiments of the present disclosure.
Figure 7B:
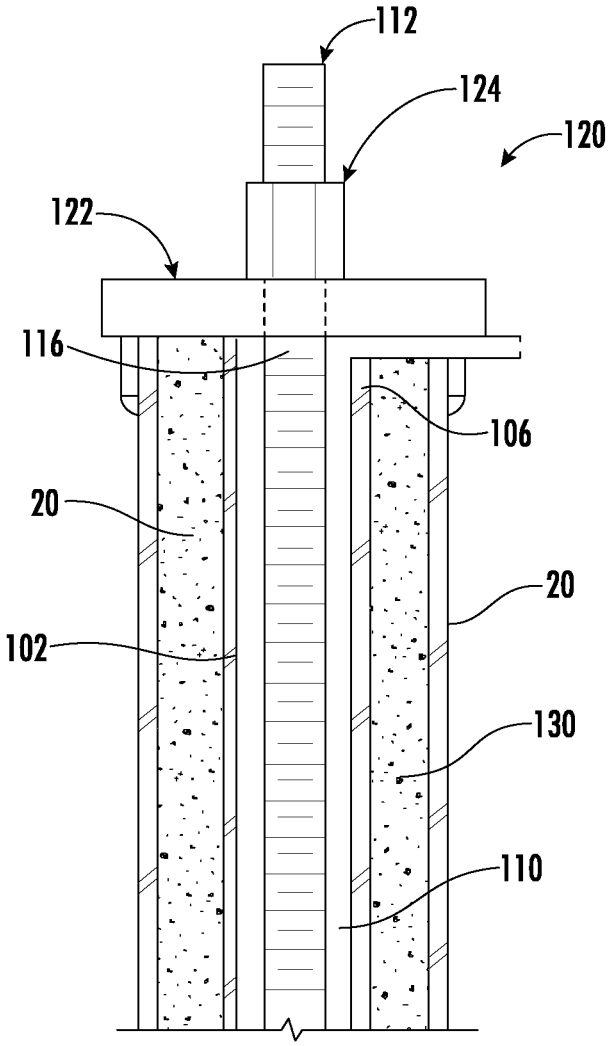
FIG. 7B illustrates an enlarged cross-sectional side view of the upper end of the HSS post-tensioned system that provides the post-tensioning, in accordance with embodiments of the present disclosure.
Figure 8A:
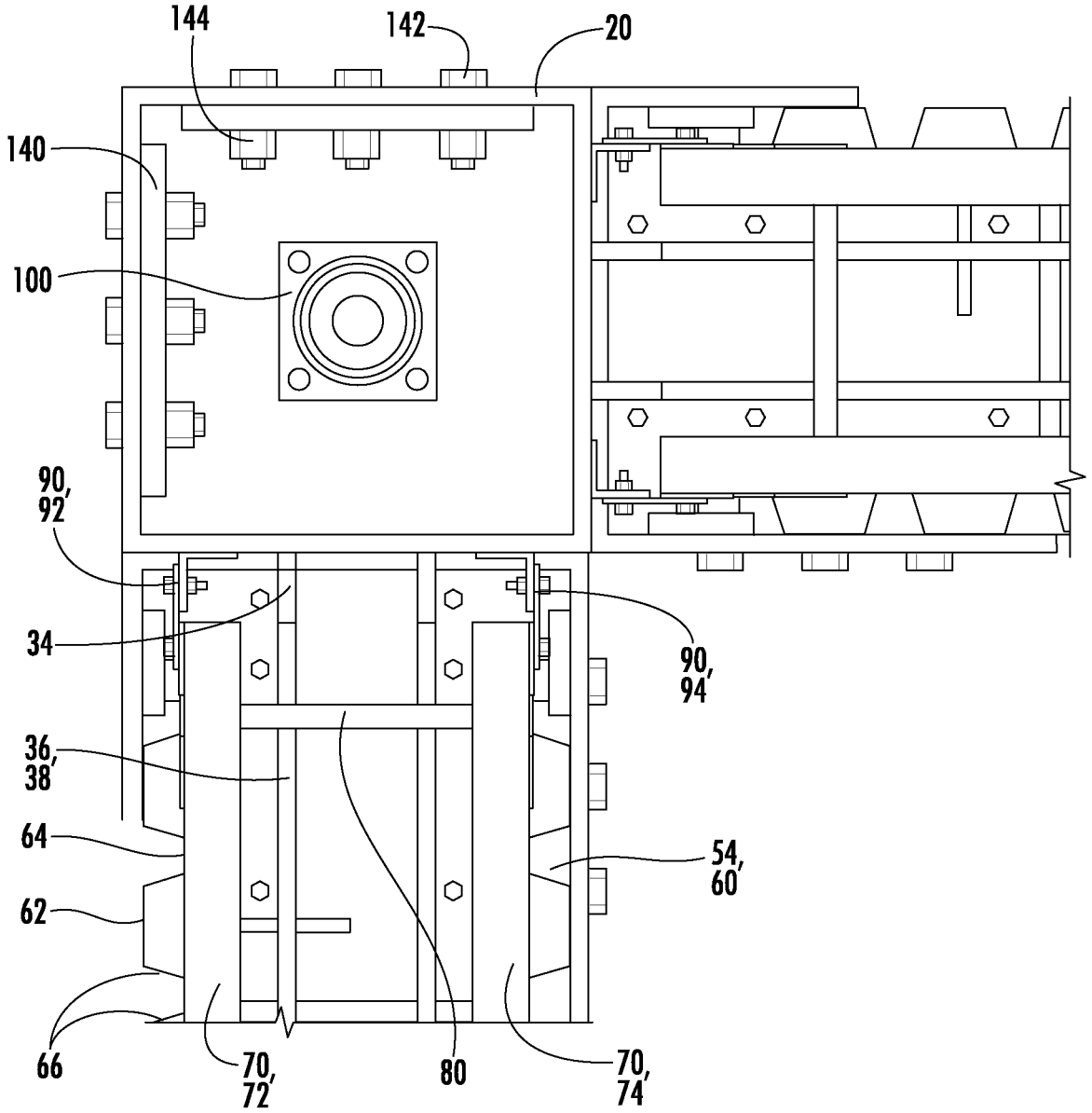
FIG. 8A illustrates an enlarged cross-sectional top view of the HSS post-tensioned system and form wall of the post-tensioned shear module, in accordance with embodiments of the present disclosure.
Figure 8B:
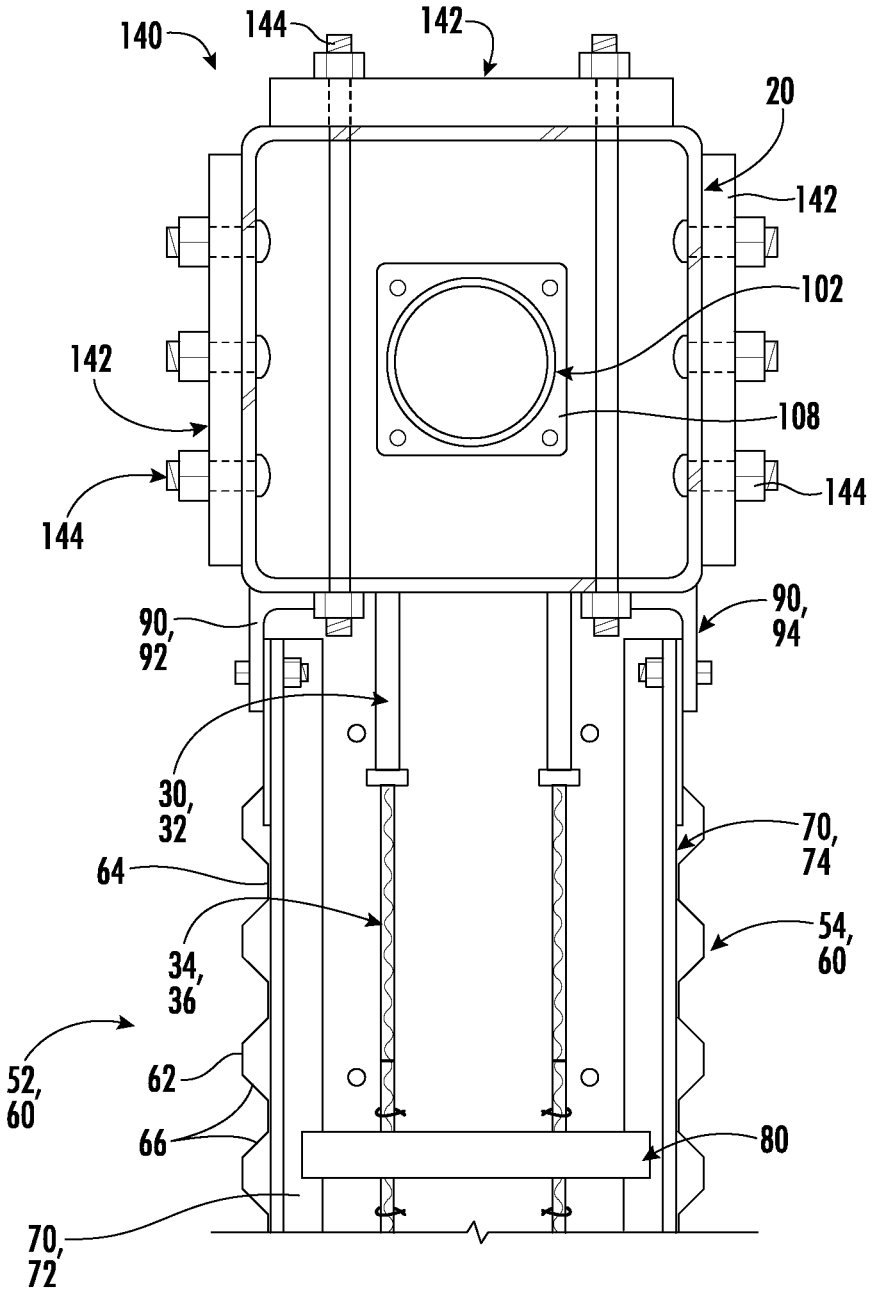
FIG. 8B illustrates an enlarged cross-sectional top view of the HSS post-tensioned system having anchors and form wall of the post-tensioned shear module, in accordance with embodiments of the present disclosure.

As further illustrated in FIGS. 7A and 7B, once the last modular section 10 is assembled within the post-tensioned shear system 1, a tensioning lock 120 (e.g., tensioning lock assembly 120, or the like) is operatively coupled to the tensioning member 112 and/or the conduit member 102 extending from the last modular section 10 within the post-tensioned shear system 1. The tensioning lock 120 may comprise a bearing member 122 (e.g., a plate, cap, cover, or the like) and/or a locking coupler 124 (e.g., locking connector, such as a locking nut, or the like). Regardless of the configuration and the components, the tensioning lock 120 is used to tension the one or more tensioning members 112.

For example, the locking coupler 124 is turned to apply a force to the bearing member 112, and thus, against the one or more conduit members 102 and/or the HSS members 20 to pull on the one or more tensioning members 112, and thus, tension the one or more tensioning members 112 of the HSS tensioned system 150.

As illustrated in the figures, and as will be described in further detail herein with respect to FIGS. 13 and 14A through 14I, conduit fill material 130 and/or HSS fill material 132 may potentially be utilized. For example, conduit fill material 130 (e.g., grease, grout, other liquid that hardens, viscous material, or other like fill material) may be inserted into (e.g., pumped into, dumped into, or the like) the post-tensioning assembly 100 (e.g., between the space formed by the internal surface of the one or more conduit members 102 and the external surface of the one or more tensioning members 112). In some embodiments, the conduit fill material 130 may be any type of material that is used to aid in preventing corrosion of, or reducing other potential damage to, the tensioning members 112. In some embodiments, the use of conduit fill material 130 may be avoided by galvanizing the tensioning members 112 and/or conduit members 102, or otherwise providing another type of coating on the tensioning members 112 and/or conduit members 102.

Moreover, in some embodiments, HSS fill material 132 (e.g., cementitious material, such as concrete, grout, other liquid that hardens, or the like fill material) may be inserted into (e.g., pumped into, dumped into, or the like) the HSS post-tensioning assembly 150 (e.g., between the space formed by the internal surface of the HSS members 20 and the external surface of the one or more conduit members 102). It should be understood that the conduit fill material 130, the HSS fill material 132, and/or the form wall fill material 42 may be any type of fill material, and may be the same or different fill materials. As such, in some embodiments the HSS fill material 132 and the form wall fill material 42 may be applied (e.g., poured, or the like) as the same time.

As illustrated FIGS. 4A through 5B, 6E and 6D, and 10A through 12B, an energy dissipation device 200 (e.g., ductile link or fuse, damper, steel devices designed to buckle, or the like) may be used in different locations of the modular post-tensioned shear system 1. For example, as illustrated in FIGS. 10A through 12B, as will be described herein, the energy dissipation devices 200 may be base energy dissipation devices 202, such as boundary base energy dissipation devices 204, such as a first boundary base energy dissipation device 206 and a second boundary base energy dissipation device 208. The boundary base energy dissipation devices 204 may be located adjacent an HSS member 20 (e.g., boundary HSS members 22, 24) at the base module 16 and/or a foundation, at a first module 12 on top of the base module 16 and/or foundation, between the first module 12 and the base module 16 and/or foundation (e.g., below the HSS members 20, below the form wall 40, or the like), or at another like location. Moreover, the base energy dissipation devices 202 may be intermediate base energy dissipation devices 214, such as a first intermediate base energy dissipation device 216 and a second intermediate base energy dissipation device 218. The intermediate base energy dissipation devices 214 may be located adjacent intermediate HSS members 26 at the base module 16 and/or foundation, at a first module 12 on top of the base module 16 and/or foundation, between the first module 12 and the base module 16 and/or foundation (e.g., below the intermediate HSS members 26, below the form wall 40, or the like), or at other like locations. Furthermore, it should be understood that wall energy dissipation devices 220 may be located within the form wall 40 of the modules 10 between support members, such as between the boundary HSS members 22, 24, between intermediate HSS members 26, or between other support members within the form wall 40.

Figure 9A:
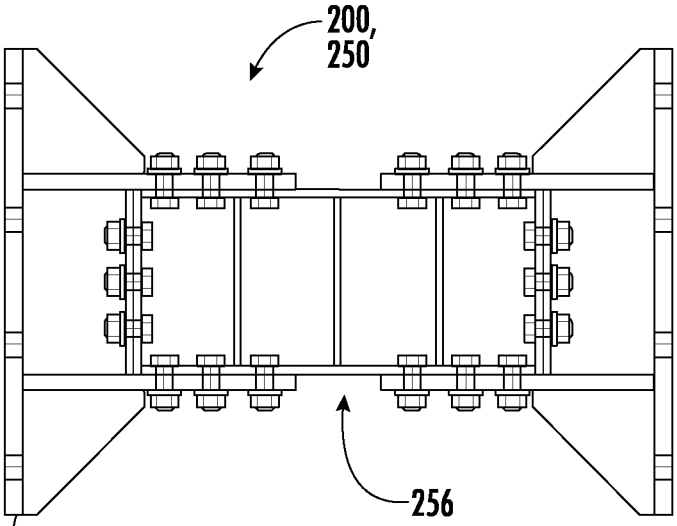
FIG. 9A illustrates a perspective view of an energy dissipation device, in accordance with embodiments of the present disclosure.
Figure 9B:
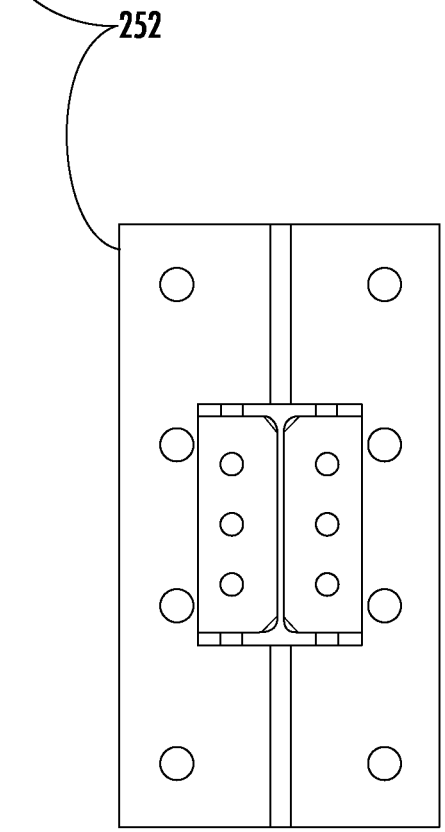
FIG. 9B illustrates a side view of the energy dissipation device of FIG. 9A, in accordance with embodiments of the present disclosure.

In some embodiments, buckling energy dissipation devices 250, such as the device illustrated in FIGS. 9A and 9B in one embodiment, may be utilized. As illustrated in FIGS. 9A and 9B, the energy dissipation device 200 may comprise a buckling energy dissipation device 250, having a first mount 252, a second mount 254, one or more buckling members 256 (e.g., layered sheets of material, horizontal and traverse connected members, or the like). FIG. 9A illustrates a cross-sectional longitudinal view of the buckling energy dissipation device 250, while FIG. 9B illustrates a transverse cross-sectional view of the energy dissipation device 250 with the one or more buckling members 256 removed. The one or more buckling members 256 may be accessible after installation such that the one or more bucking members 256 may be replaceable after a cyclic loading event.

In other embodiments of the invention, the energy dissipation devices 200 may be viscoelastic coupling dampers. For example, one embodiment of the viscoelastic coupling damper comprises stacked steel plates on either end, or other steel mounts coupled to overlapping steel plates within the middle, separated by viscoelastic polymers between the overlapping steel plates (or other similar configurations). In other embodiments, viscous fluid dampers, for example, using hydraulics, may be used as the energy dissipation devices, such as between members within the modular post-tensioned shear system 1. In other embodiments friction dampers (e.g., linear, rotational, or the like) may be used as the energy dissipation devices. In other embodiments steel fuses may also be used as the energy dissipation devices. In other embodiment, metal bellow dampers may be utilized. In other embodiments, tuned mass dampers may be utilized in the modular post-tensioned shear system 1.

Figure 10A:
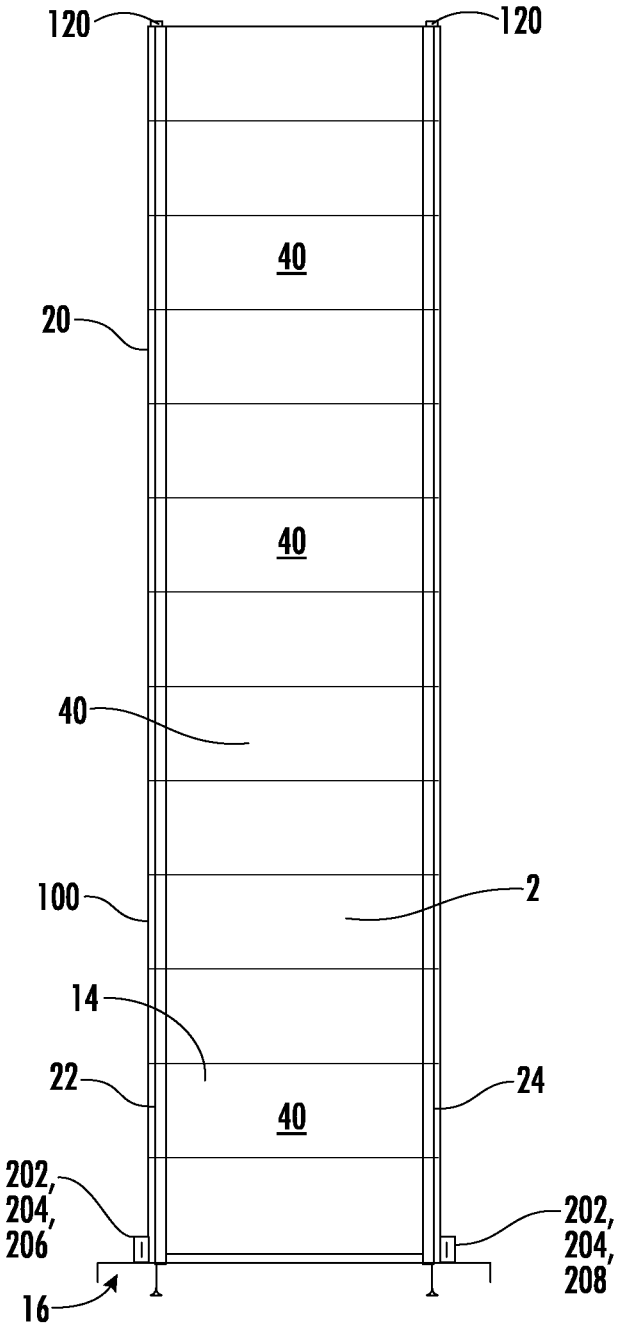
FIG. 10A illustrates a side view of a modular post-tensioned shear wall system with boundary HSS tensioned systems, in accordance with embodiments of the present disclosure.
Figure 10B:
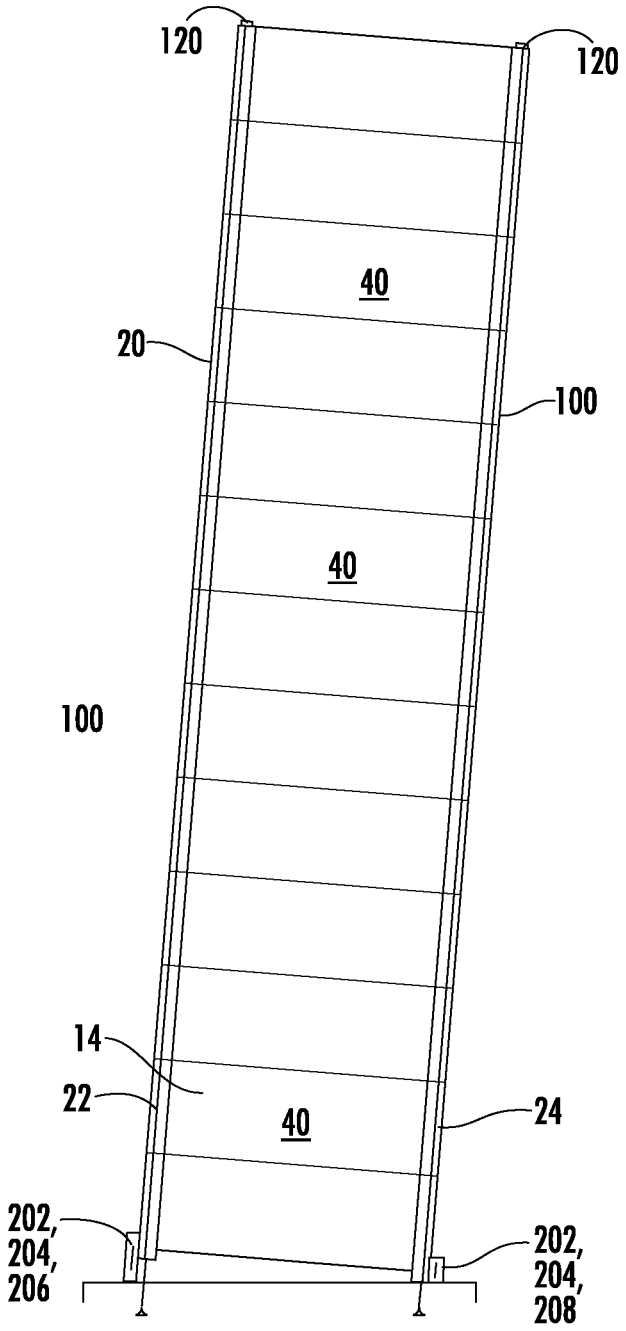
FIG. 10B illustrates a side view of the rocking behavior of the modular post-tensioned shear wall system of FIG. 10A, in accordance with embodiments of the present disclosure.

FIGS. 10A and 10B illustrate one embodiment of the modular post-tensioned shear system 1. FIG. 10A illustrates the installed (or non-rocking) position, while FIG. 10B illustrates when the modular post-tensioned shear system 1 is subjected to cyclic loading. As illustrated in the figures, in this embodiment the modular post-tensioned shear system 1 utilizes boundary HSS members 22, 24 without the use of intermediate HSS members 26. The boundary HSS members 22, 24 include boundary post-tensioning assemblies 100, which when used with the boundary HSS members 22, 24 form boundary HSS post-tensioned systems 152, 154 (e.g., first and second boundary HSS post-tensioned systems 152, 154). Moreover, energy dissipation devices 200, such as a first boundary base energy dissipation device 206 and a second boundary base energy dissipation device 208 may be operatively coupled to the boundary HSS members 22, 24 (e.g., a first HSS member 22 and a second HSS member 24) and the base module 16 and/or a foundation. As such, as illustrated in FIG. 10B, when exposed to cyclic loading the first boundary HSS post-tensioning system 152 is put in further tension and the first boundary base energy dissipation device 206 is activated (e.g., expanded, tensioned, or the like), while the second boundary HSS post-tensioning system 154 is relieved of at least some tension (and put into compression in some cases) and the second boundary base energy dissipation device 208 is activated (e.g., retracted, compressed, or the like). The opposite occurs when the modular post-tensioned shear system 1 is loaded in the opposite direction.

Figure 11A:
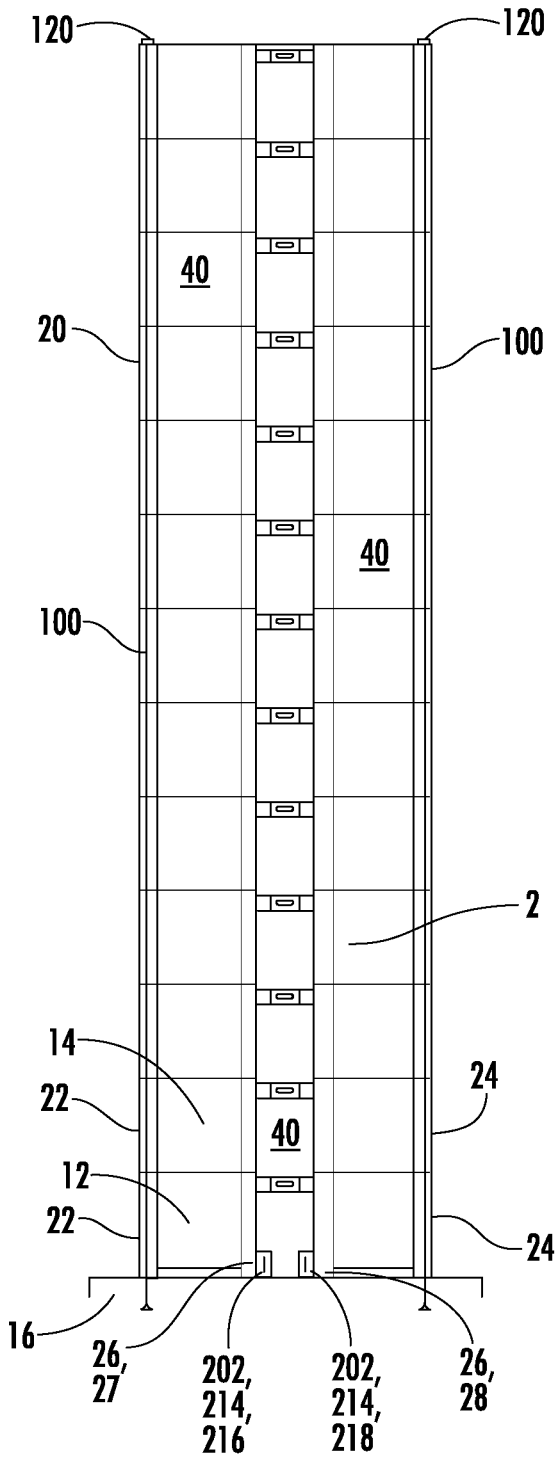
FIG. 11A illustrates a side view of modular post-tensioned shear wall system with wall energy dissipating devices and boundary HSS tensioned systems, in accordance with embodiments of the present disclosure.
Figure 11B:
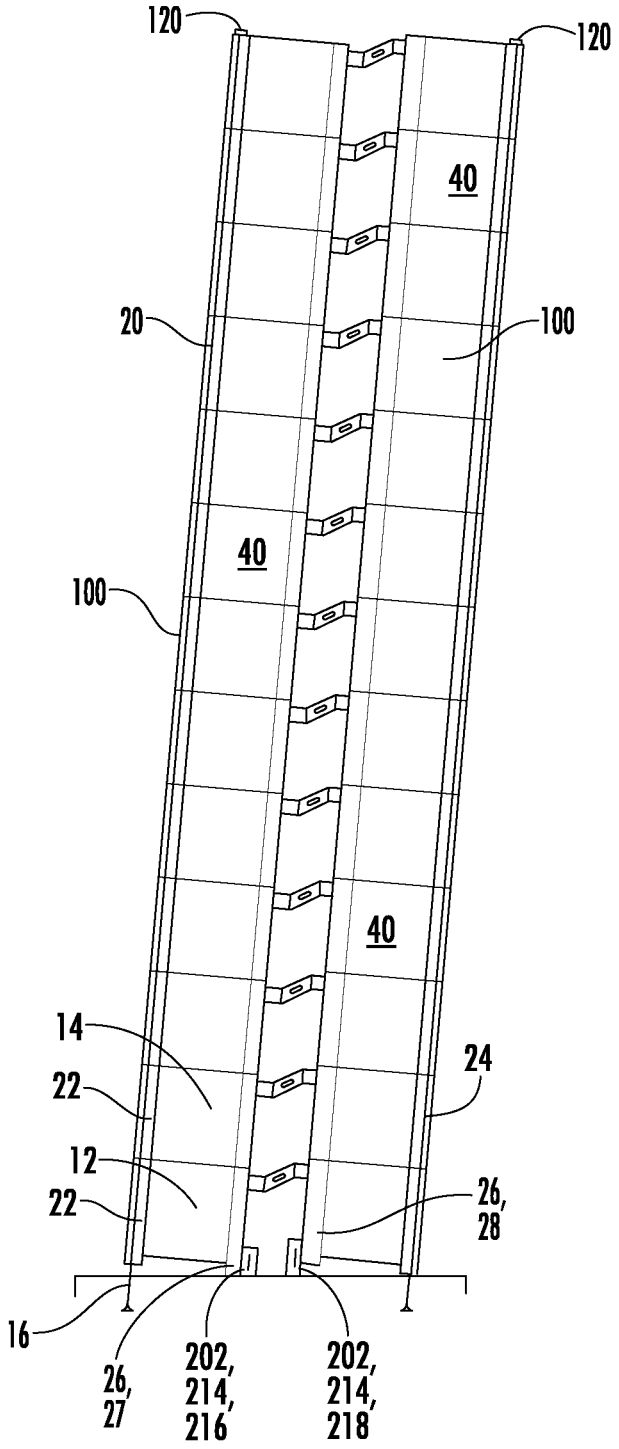
FIG. 11B illustrates a side view of the rocking behavior of the modular post-tensioned shear wall system of FIG. 11A, in accordance with embodiments of the present disclosure.

Alternatively, FIGS. 11A and 11B illustrates an alternate embodiment of the modular post-tensioned shear system 1. FIG. 11A illustrates the installed (or non-rocking) position, while FIG. 11B illustrates when the modular post-tensioned shear system 1 is subjected to cyclic loading. As illustrated in the figures, in this embodiment the modular post-tensioned shear system 1 utilizes boundary HSS members 22, 24, as well as intermediate HSS members 26. The boundary HSS members 22, 24 include boundary post-tensioning assemblies 100, which when used with the boundary HSS members 22, 24 form boundary HSS post-tensioning systems 152, 154 (e.g., first and second boundary HSS post-tensioning systems 152, 154). Moreover, energy dissipation devices 200, such as a first intermediate base energy dissipation device 216 and a second intermediate base energy dissipation device 218 may be operatively coupled to the intermediate HSS members 22, 24 (e.g., a first HSS intermediate member 27 and a second intermediate HSS member 28) and the base module 16 and/or a foundation. Furthermore, a plurality of wall energy dissipation devices 220 (e.g., one wall energy dissipation device 220 in each modular section 10, such as the buckling energy dissipation device 250, the viscoelastic coupling dampers 260, or the like) may be utilized within the form wall 40, such as operatively coupled to the first HSS intermediate member 27 and a second intermediate HSS member 28 of each module section 10. As such, as illustrated in FIG. 11B, when exposed to cyclic loading the first boundary HSS post-tensioning system 152 is put in further tension and the first intermediate base energy dissipation device 216 is activated (e.g., expanded, tensioned, or the like), while the second boundary HSS post-tensioning system 154 is relieved of tension (and in some cases put into compression) and the second intermediate base energy dissipation device 208 is activated (e.g., retracted, compressed, or the like). Furthermore, the plurality of wall energy dissipation devices 220 are activated (e.g., buckled, expanded, tensioned, contracted, compressed, deformed, or the like). The opposite configuration occurs when the modular post-tensioned shear system 1 is loaded in the opposite direction.

Figure 12A:
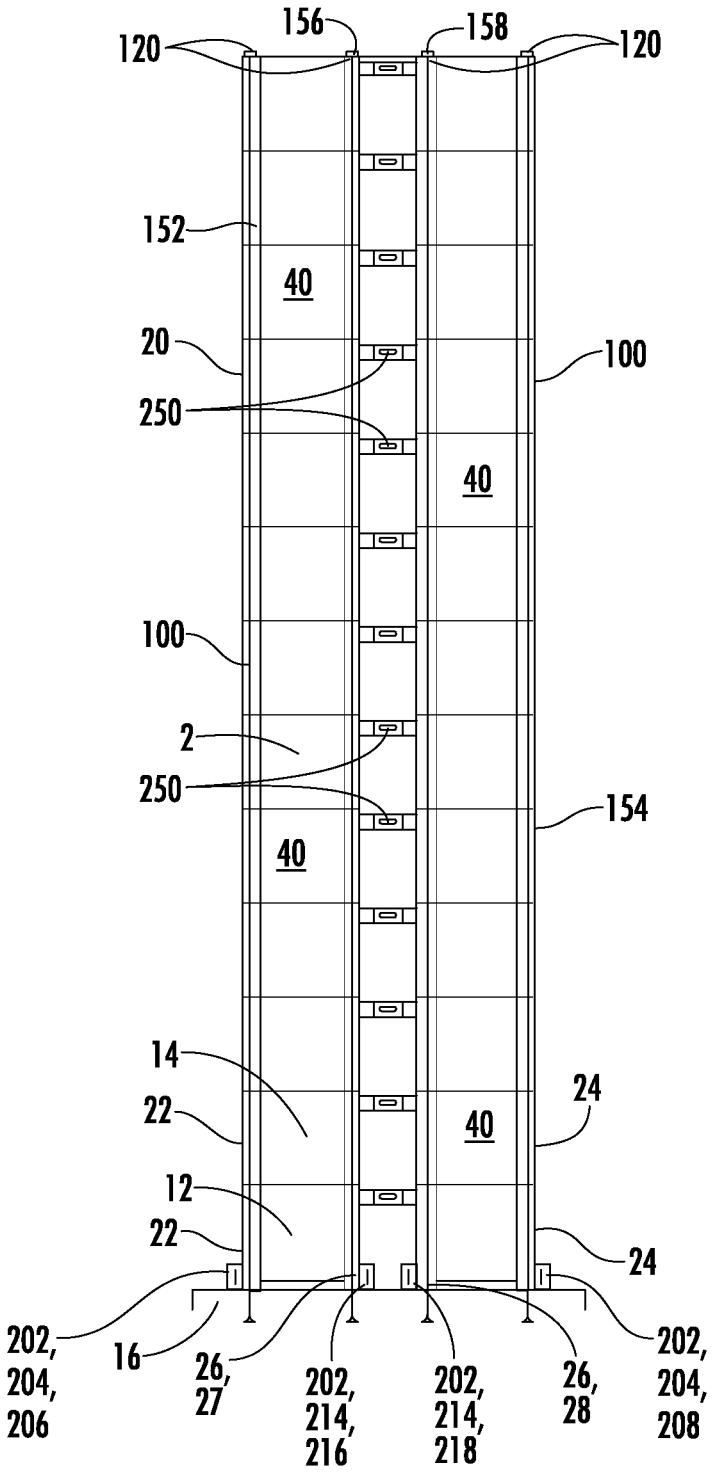
FIG. 12A illustrates a side view of a modular post-tensioned shear wall system with wall energy dissipating devices and boundary and interior HSS post-tensioned systems, in accordance with embodiments of the present disclosure.
Figure 12B:
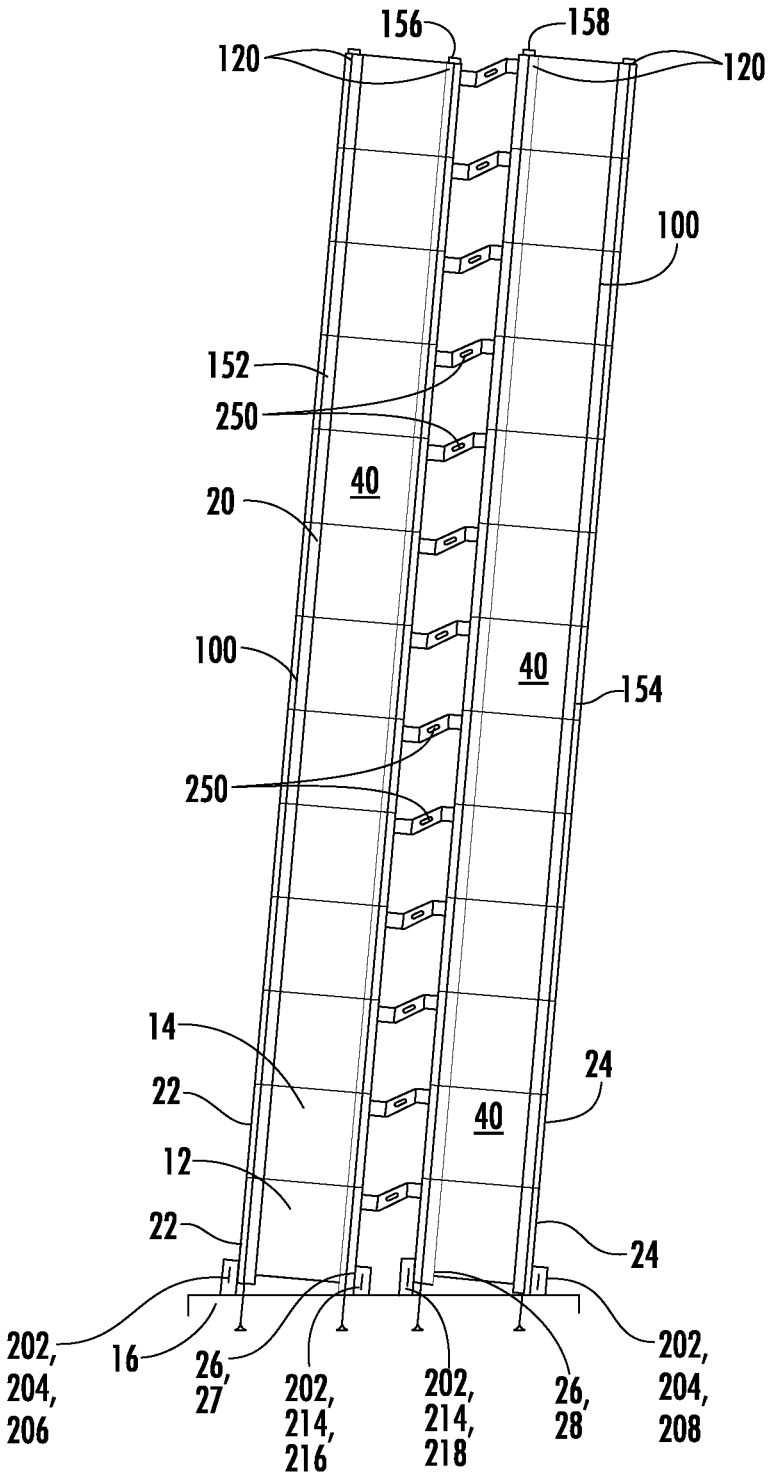
FIG. 12B illustrates a side view of the rocking behavior of the modular post-tensioned shear wall system of FIG. 12B, in accordance with embodiments of the present disclosure.

Alternatively, FIGS. 12A and 12B illustrate an alternate embodiment of the modular post-tensioned shear system 1. FIG. 12A illustrates the installed (or non-rocking) position, while FIG. 12B illustrates when the modular post-tensioned shear system 1 is subjected to cyclic loading. As illustrated in the figures, in this embodiment the modular post-tensioned shear system 1 utilizes boundary HSS members 22, 24, as well as intermediate HSS members 26. The boundary HSS members 22, 24 and the intermediate HSS members 26 include post-tensioning assemblies 100, which when used with the boundary HSS members 22, 24 form boundary HSS post-tensioned systems 152, 154 (e.g., first and second boundary HSS post-tensioning systems 152, 154) and when used with intermediate HSS members 27, 28 form intermediate HSS post-tensioned systems 156, 158. Moreover, energy dissipation devices 200, such as a first boundary base energy dissipation device 206 and a second boundary base energy dissipation device 208 may be operatively coupled to the boundary HSS members 22, 24 (e.g., a first HSS member 22 and a second HSS member 24) and the base module 16 and/or a foundation. Moreover, energy dissipation devices, such as a first intermediate base energy dissipation device 216 and a second intermediate base energy dissipation device 218 may be operatively coupled to the intermediate HSS members 26 (e.g., a first HSS intermediate member 27 and a second intermediate HSS member 28) and the base module 16 and/or a foundation. Furthermore, a plurality of wall energy dissipation devices 220 (e.g., one wall energy dissipation device 220 in each modular section 10, such as the buckling energy dissipation devices 250) may be utilized within the form wall 40, such as operatively coupled to the first HSS intermediate member 27 and a second intermediate HSS member 28 of each module section 10. As such, as illustrated in FIG. 12B, when exposed to cyclic loading the first boundary HSS post-tensioned system 152 and the first intermediate boundary HSS post-tensioned system 156 are put in further tension, and the first boundary base energy dissipation device 206 and the intermediate base energy dissipation device 216 are activated (e.g., expanded, tensioned, or the like). Alternatively, the second boundary HSS post-tensioned system 154 and the second intermediate HSS post-tensioned system 158 are relieved of tension (and in some cases put into compression) and the second boundary base energy dissipation device 208 and the second intermediate base energy dissipation device 218 are activated (e.g., retracted, compressed, or the like). Furthermore, the plurality of wall energy dissipation devices 220 are activated (e.g., buckled, expanded, tensioned, contracted, compressed, deformed, or the like). The opposite configuration occurs when the modular post-tensioned shear system 1 is loaded in the opposite direction.

It should be further understood that in some embodiments of FIG. 12A, the post-tensioning assemblies 100 may not be utilized in the first boundary HSS member 22 and the second boundary HSS member 24 and/or the first boundary base energy dissipation device 206 and a second boundary base energy dissipation device 208 may not be utilized at the HSS members 22, 24.

It should be further understood that any combination of post-tensioning assemblies 100 and/or energy dissipation devices 200 may be utilized within the modular post-tensioned shear system 1, in order to provide different configurations that may achieve different results (e.g., based on location of the building; seismic, wind, or other loading; temperature gradients for the building; controlling displacement of the building or a portion thereof; or other like building conditions).

Figure 13:
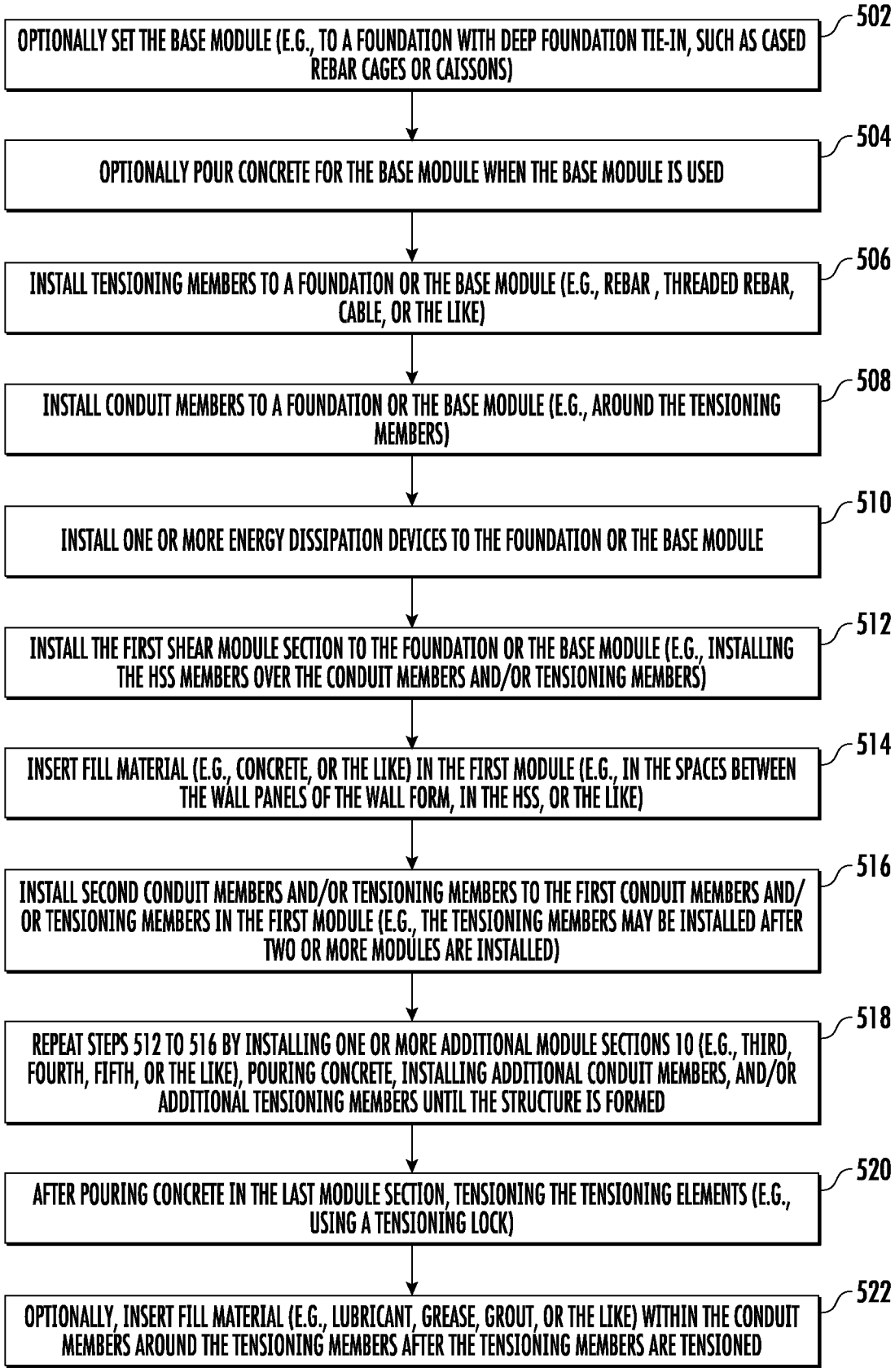
FIG. 13 illustrates a process flow for installing a modular post-tensioned shear system for a single wall or multi-wall system, in accordance with embodiments of the present disclosure.
Figure 14A:
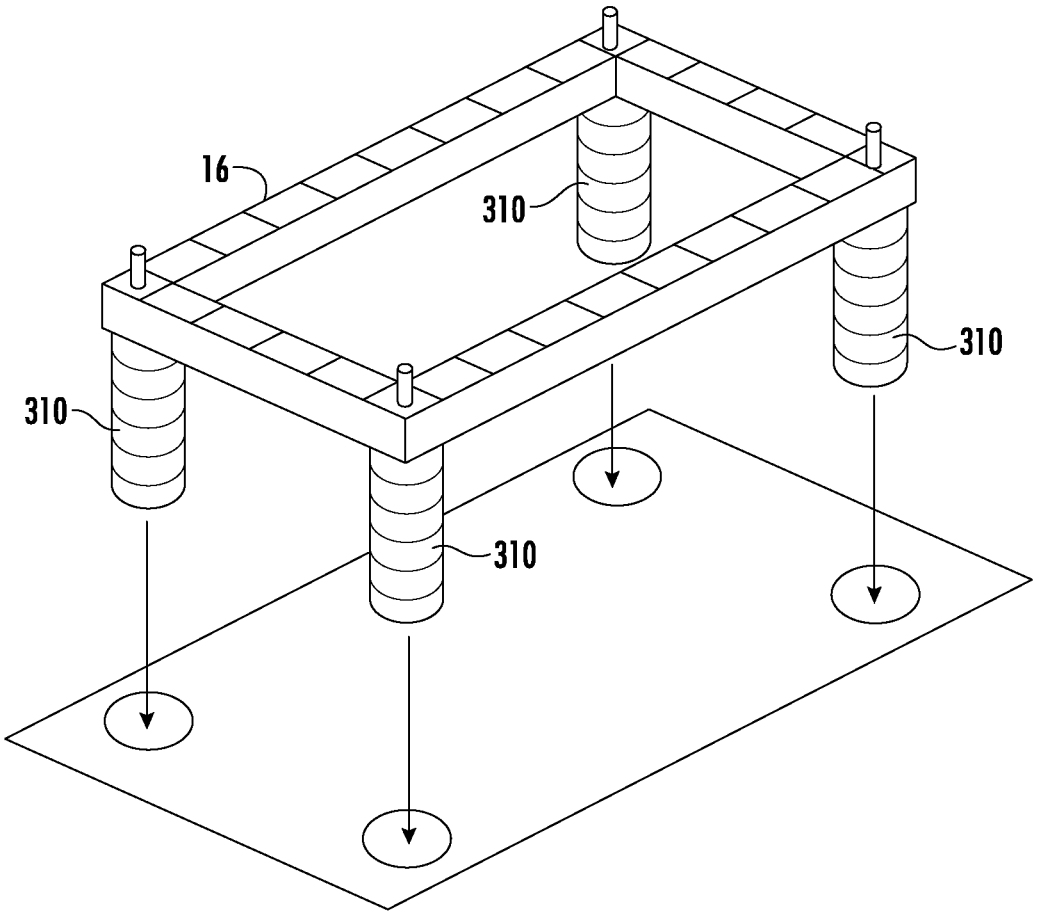
FIG. 14A illustrates forming of the base module of the post-tensioned shear system, in accordance with embodiments of the present disclosure.

FIG. 13 illustrate a process 500 for assembling the modular post-tensioned shear system 1, while FIGS. 14A through 14I illustrate embodiments of the assembly of the modular post-tensioned shear system 1. As illustrated by block 502 of FIG. 13, the base module 16 may be optionally installed. For example, as illustrated in FIG. 14A the base module 16 may be tied to, or include foundation supports 310 (e.g., rebar cages, caissons, piles, or the like). Moreover, the base module 16 may include one or more wall supports 312 (e.g., horizontal, vertical, webs, other support elements). The wall supports 312 may be the same as or similar to the modular sections 10 previous described herein. However, it should be understood that the base module 16 may be any type of support having different foundation supports 310, wall supports 312, and/or any other types of supports. Alternatively, in some embodiments, instead of using a base module 16, a foundation is prepared for assembly with a first module 12.

Figure 14B:
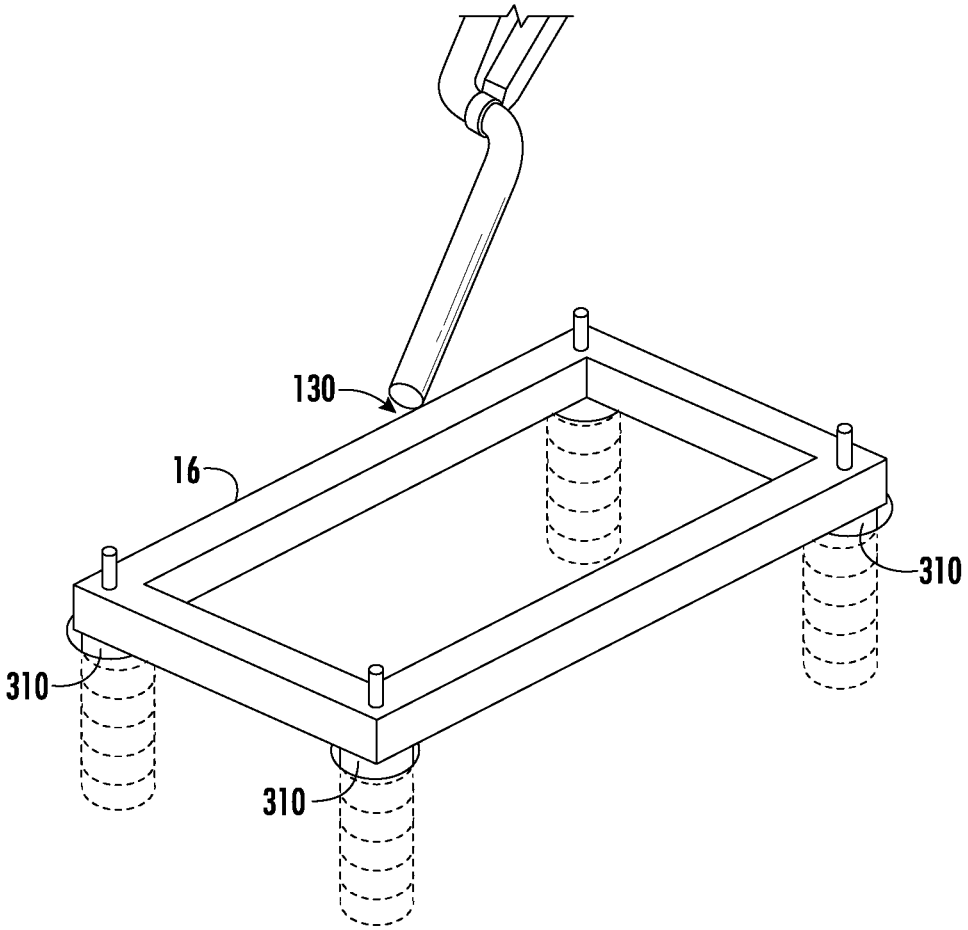
FIG. 14B illustrates pouring fill material in the base module of the post-tensioned shear system, in accordance with embodiments of the present disclosure.

Block 504 of FIG. 13 illustrates that fill material is optionally inserted into the base module 16. For example, as previously discussed herein, the base fill material may be the same as or similar to the form wall fill material 42 and/or the HSS fill material 130 (e.g., cement, cocreate, or the like is poured into the base module 16). The base fill material may be inserted into the foundation supports 310 (e.g., rebar cages, caissons, or the like) and/or the one or more wall supports 312. For example, FIG. 14B illustrates concrete being poured into the base module 16. Alternatively, in some embodiments, when a base module 16 is not used, the fill material may be used to form the foundation.

Figure 14C:
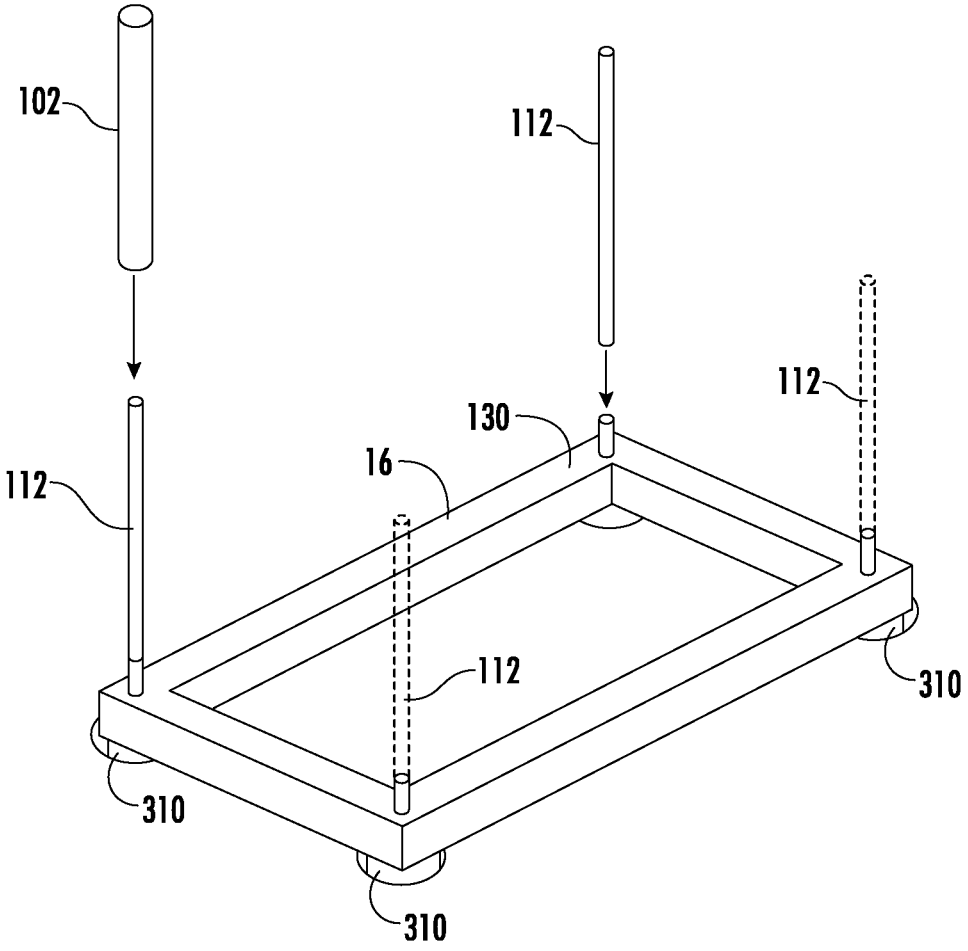
FIG. 14C illustrates assembling conduit and/or tensioning elements to the base module of the post-tensioned shear system, in accordance with embodiments of the present disclosure.

FIG. 13 further illustrates that portions of the post-tensioning assemblies 100 may be operatively coupled to the base module 16 and/or a foundation (before or after the fill material is poured into the base module 16 and/or foundation). For example, as illustrated in block 506 the tensioning members 112 of the post-tensioning assemblies 100 may be operatively coupled to the base module 16 and/or a foundation. As illustrated in FIG. 14C and FIG. 6A, the tensioning member 112 (e.g., threaded rebar 110, or the like) may be operatively coupled to the base module 16 and/or a foundation, such as to base module members and/or foundation members (e.g., rebar, anchor, or the like) located within the base module 16 and/or foundation. In some embodiments the base module member and/or foundation member may be a portion of a threaded rebar, or the like, and a tensioning member 112 may be operatively coupled to the threaded rebar, or the like (e.g., through the use of a tensioning coupling 118). In some embodiments, as illustrated in FIG. 6A, the tensioning member 112 may be operatively coupled to a foundation bracket 160 (e.g., a plate, H-shaped support with a pocket, I-shaped support with a pocket, or the like), which is located within the base module 16 and/or a foundation, using fastener(s) 162 (e.g., anchors, nuts, or the like). In some embodiments, the tensioning member 112 is operatively coupled to a plate bracket 164 through the use of a nut 166. In some embodiments, the nut 166 may be accessed through the pocket (e.g., a steel pocket, or the like) formed by or within the bracket 160 that allows for access to the fasteners 160 (e.g., nut, or the like) for engagement, adjustment, or disengagement of the tensioning member 112 at the base module 16 and/or foundation.

Moreover, block 508 of FIG. 13 illustrates that the conduit members 102 are operatively coupled to the base module 16 and/or a foundation, such as by being placed over the tensioning members 112. The conduit members 102 may be operatively coupled to the base module 16 and/or a foundation using one or more conduit couplings 108, such as fasteners, brackets, welds, and/or other like couplings. As illustrated in FIG. 6A, in some embodiments, the conduit member 102 is operatively coupled to the base module 16 and/or a foundation through the bracket 160 in the same or similar way as previously discussed above with respect to the tensioning member 112.

Block 510 of FIG. 13 illustrates that one or more energy dissipation devices 200, such as the one or more base energy dissipation devices 202 described herein, may be operatively coupled to the base module 16 and/or foundation. For example, the use of energy dissipation devices 200 may be determined based on the location of the building, and in particular, based on the estimated seismic or other loading expected for the area. In some embodiments the base energy dissipation devices 202 may not be utilized in the modular post-tensioned shear system 1.

It should be understood that the steps described for assembling the building in FIG. 13, and in particular, the assembly of the tensioning members 112, the conduit members 102, and/or the energy dissipation devices 200, may occur in any order.

Figure 14D:
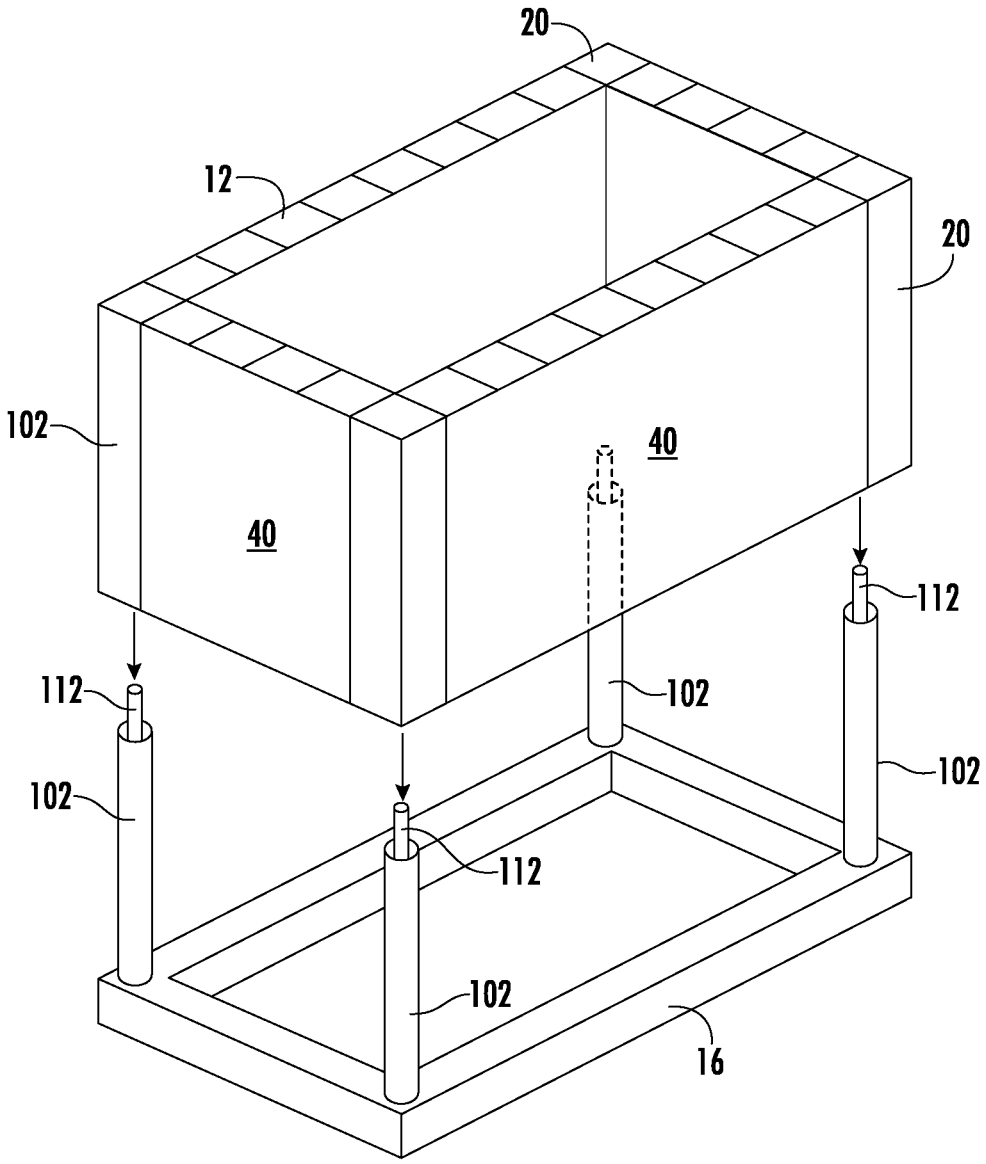
FIG. 14D illustrates assembling a first core shear module to the base module, in accordance with embodiments of the present disclosure.

FIG. 13 illustrates in block 512 that a first module section 12 is operatively coupled to the base module 16. For example, as illustrated in FIG. 14D, the first module section 12 may be lowered over the conduit members 102 and/or the tensioning members 112 extending from the base module 16. The HSS members 20 in the first module section 12 extend over the conduit members 102 and/or the tensioning members 112. The proximal conduit ends 104 of the conduit members 102 and/or the proximal tensioning ends 114 of the tensioning members 112 may have a portion that extends out of the HSS members 20. In some embodiments the first module section 12 may be lowered by a crane, overhead lift, helicopter, or other lifting device and/or guided by installers on the ground. The HSS members 20 and/or the form wall 40 of the first module section 12 may be operatively coupled to the base module 16 and/or foundation directly, or through the use of one or more base energy dissipation devices 202, through the use of brackets, fasteners, or other like couplings.

Figure 14E:
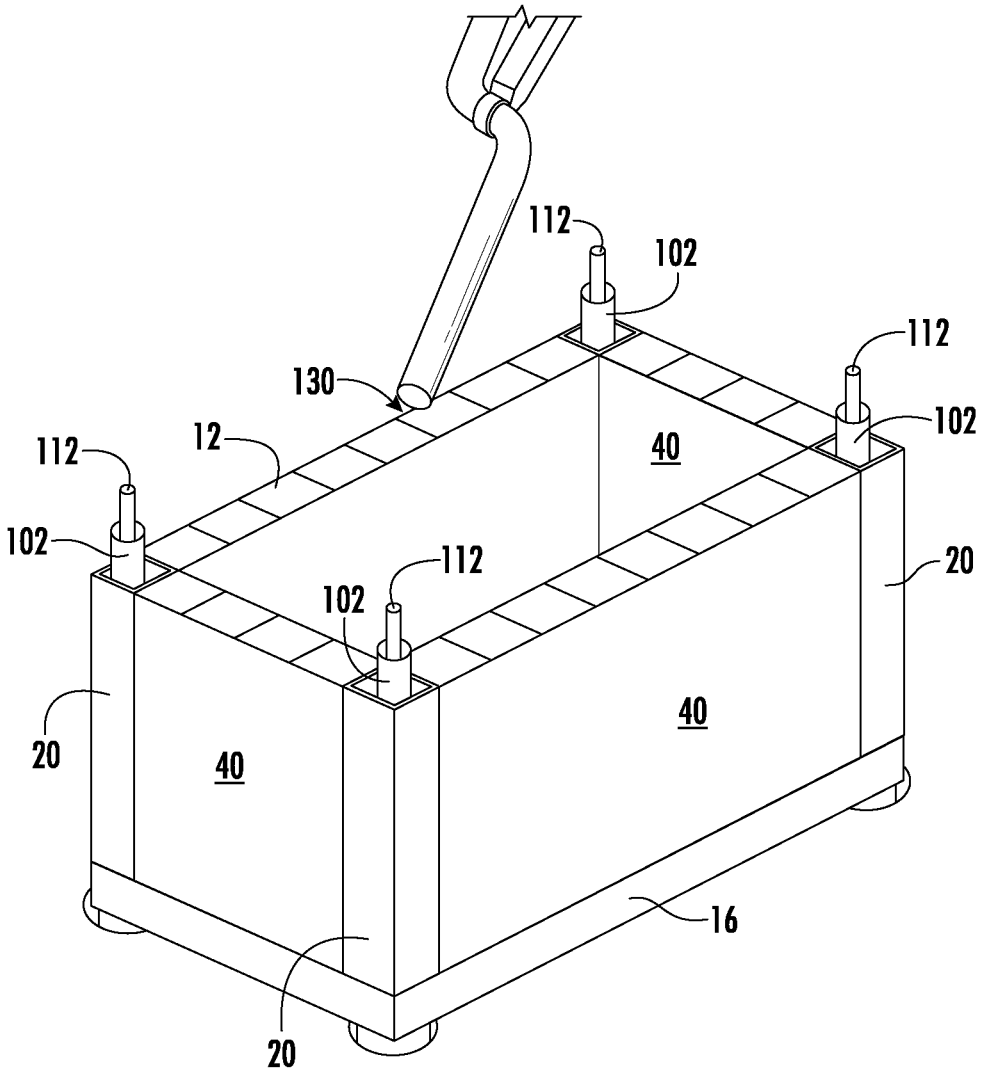
FIG. 14E illustrates optionally pouring fill material in the first core shear module, in accordance with embodiments of the present disclosure.

Block 514 of FIG. 13 illustrates that fill material (e.g., cement, concrete, or the like) is inserted into the first module section 12, such as in the form wall 40 of the first module section 12 and/or in the HSS members 20 outside of the conduit members 102. For example, FIG. 14E illustrates that concrete is poured into the form wall 40 between the one or more inner panels 52 and one or more outer panels 54. Moreover, FIG. 6A illustrates the fill material (e.g., concrete, or the like) between the inner surface of the HSS members 20 and the outer surface of the conduit member 102.

Figure 14F:
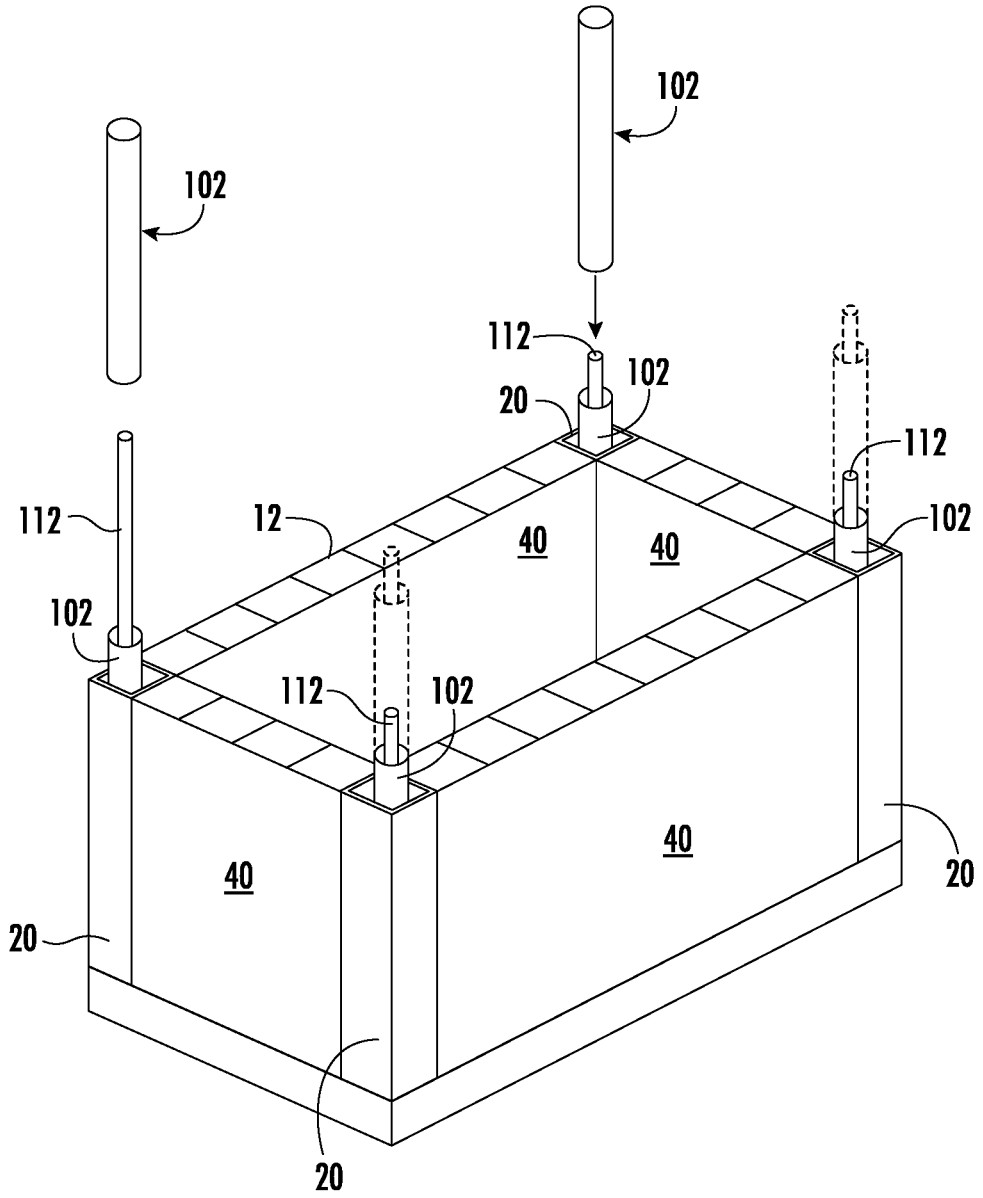
FIG. 14F illustrates assembling conduit and/or tensioning elements to the conduit and/or tensioning elements of the first core shear module, in accordance with embodiments of the present disclosure.

FIG. 13 further illustrates in block 516 that second conduit members 102 and/or second tensioning members 112 may be operatively coupled to the first conduit members 102 and/or the first tensioning members 112 within the HSS members 20 of the first module section 12. As illustrated in FIG. 14F and previously described herein, tensioning member couplings 118 are utilized to operatively couple a distal tensioning end 114 of the second tensioning members 112 to the proximal tensioning ends 116 of the first tensioning members 112. Furthermore, the conduit member couplings 108 are utilized to operatively coupled a distal conduit end 104 of the second conduit members 102 to the proximal conduit ends 106 of the first conduit members 102 around the second tensioning members 112. In some embodiments, as previously discussed herein, the one or more tensioning members 112 may be assembled after the modular sections 10 are assembled.

Figure 14G:
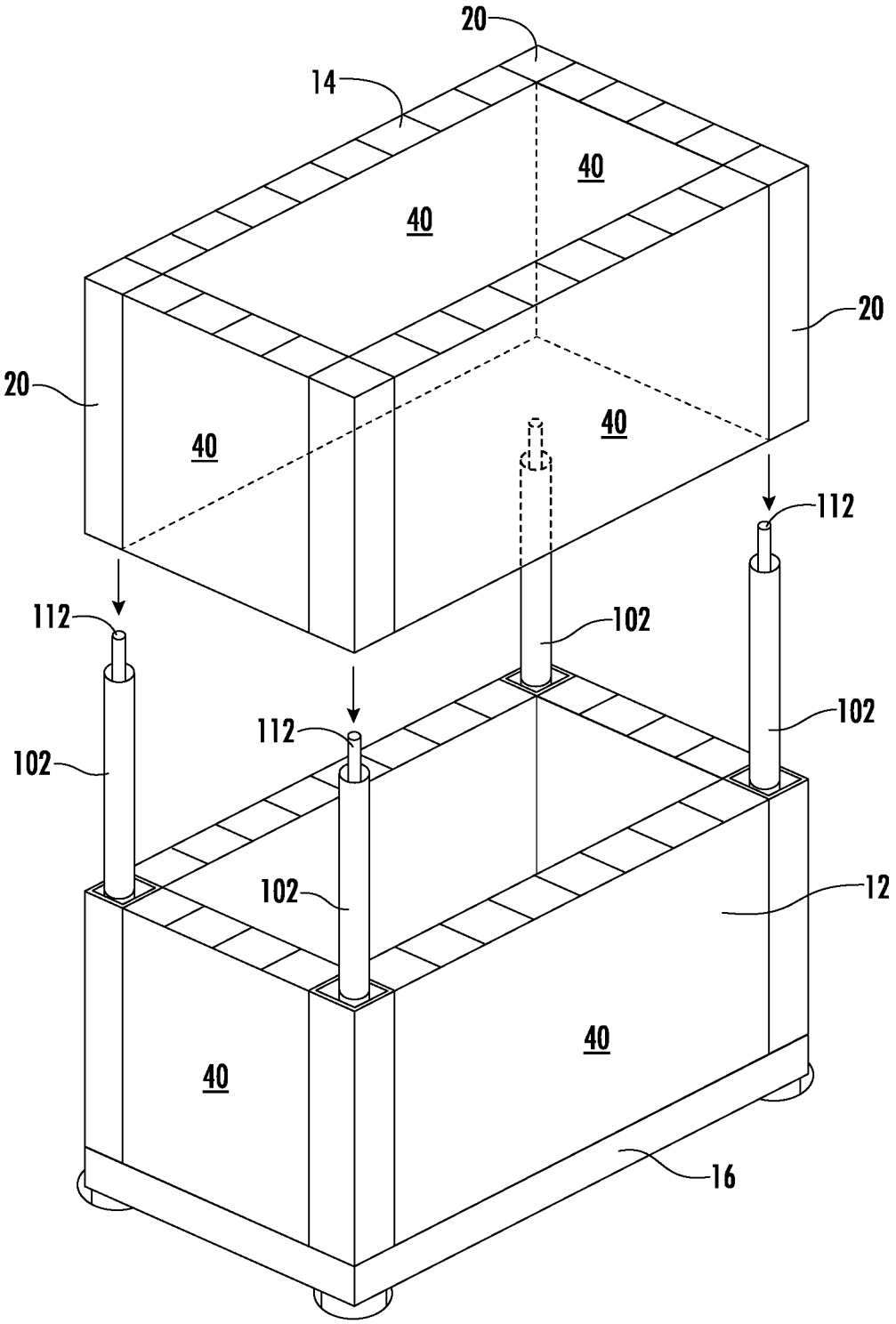
FIG. 14G illustrates assembling a second core shear module to the base module, in accordance with embodiments of the present disclosure.
Figure 14H:
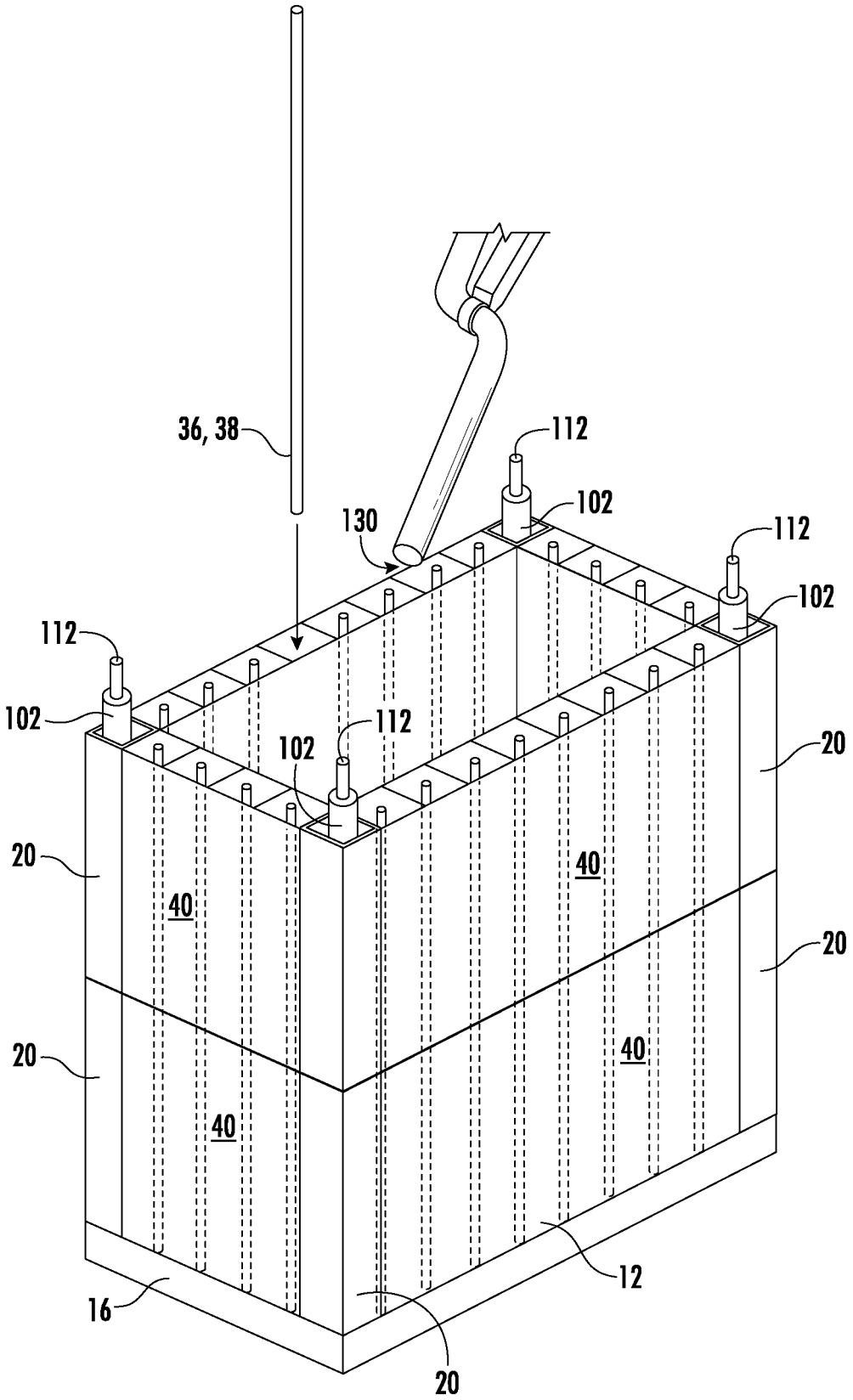
FIG. 14H illustrates assembling additional support members into adjacent shear modules and/or pouring fill material into the second core shear module and/or the first core shear module, in accordance with embodiments of the present disclosure.
Figure 14I:
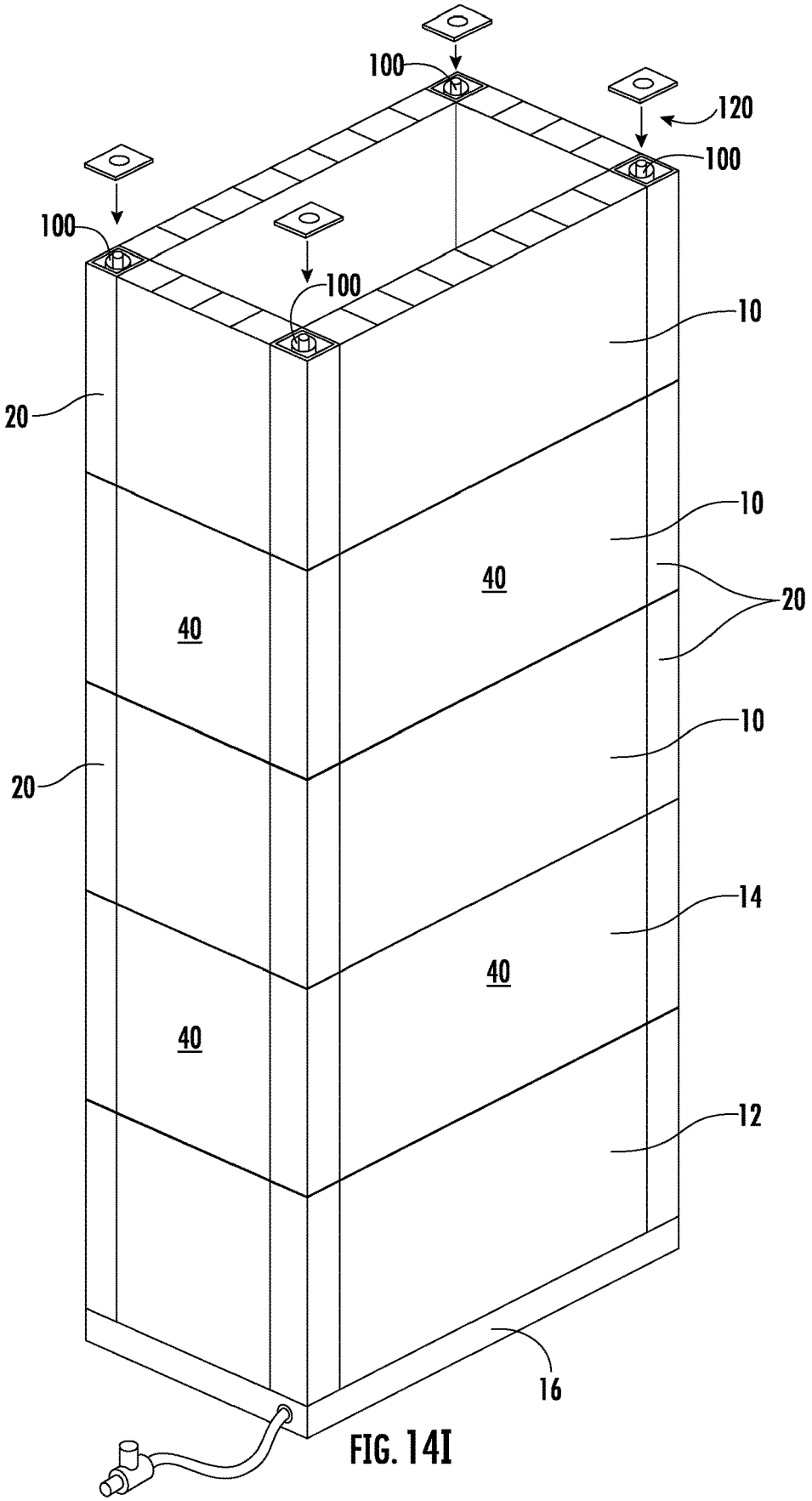
FIG. 14I illustrates post-tensioning the HSS tensioned systems and filling the conduit of the post-tensioned shear system, in accordance with embodiments of the present disclosure.

Block 518 of FIG. 13, and FIGS. 14G and 14H, illustrates that steps 512 to 516 are repeated to install one or more additional module sections 10 (e.g., third, fourth, fifth, or $N^{th}$), pouring the fill material within the form walls 40 and/or the HSS members 20 of the additional modules, installing additional tensioning members 112, and/or additional conduit members 102 until the module sections 10 of the modular post-tensioned shear system 1 is installed. As illustrated in FIG. 14H, in some embodiments additional lattice members 36 (e.g., rebar members), such as vertical lattice members 36 may be inserted into the form walls 40 between adjacent modules (e.g., before pouring the wall fill material 42) to improve the structural support of the modular post-tensioned shear system 1.

FIG. 13 further illustrates in block 520 that after pouring the fill material into the last module section 10, the post-tensioning assemblies 100 are completed. For example, as illustrated in FIGS. 141 and 6A and as previously discussed herein, a tensioning lock 120 is operatively coupled to the tensioning member 112, the conduit member 102, and/or the HSS member of the last modular section 10 within the modular post-tensioned shear system 1. The tensioning lock 120 may comprise a bearing member 122 (e.g., a bracket, such as a plate, or the like) and/or a locking coupler 124

(e.g., locking connector, such as a locking nut, or the like). The tensioning lock 120 is used to tension the one or more tensioning members 112. For example, the locking coupler 124 is turned to apply a force to the bearing member 122, and thus, against the one or more conduit members 102 and/or the HSS members 20 to pull the one or more tensioning members 112, and thus, tension the one or more tensioning members 112.

Block 522 of FIG. 13 further illustrates that conduit fill material 130 (e.g., concrete, grout, or the like) may be inserted into the conduit members 102 around the tensioning members 112 after the tensioning members 112 are tensioned. FIGS. 141 and 6A illustrate that grout is pumped into the conduit members 102. In other embodiments, conduit fill material 130 may be poured into the conduit members 102 from the top of the last module section 10 in the modular post-tensioned shear system 1. It should be understood, that in some embodiments conduit fill material 130 may not be used.

It should be understood that the present invention provides improvements over traditional concrete shear resisting systems and/or traditional modular systems. In particular embodiments, the use of the conduit members 102 and/or the tensioning members 112 allows for improved assembly processes since the conduit members 102 and/or the tensioning members 112 may be installed with each modular section 10. While the tensioning members 112 may be installed after the two or more modular sections 10 have been assembled together, it may be difficult to drop (e.g., for bars) and/or thread (e.g., for cables), the tensioning members the length of the stacked HSS members 20, in particular for taller post-tensioned systems. As such, embodiments of the present invention allow for assembly (and disassembly) of the tensioning assemblies 100 as each modular section 10 is installed, making it a much easier assembly process, which reduces labor and construction costs. Furthermore, it should be understood that traditional concrete shear systems require large amounts of rebar to form the cages and large amount of concrete to achieve the shear performance of the structures, in particular, in seismic regions. The modular post-tensioned shear system 1 described herein reduces the amount of support members, in particular rebar, by 10, 20, 30, 40, 50, 60, 70, 80, 90, 100, 120, 140, 160, 180, 200, or the like percent (or any ranges that fall inside, overlap, or fall outside of these values). The reduction of rebar reduces the material costs and labor costs typically required to create concrete shear systems. Moreover, the modular post-tensioned shear system described herein reduces the amount of concrete (or other fill material) used by 10, 20, 30, 40, 50, 60, 70, 80, 90, 100, 120, 140, 160, 180, 200, or the like percent (or any ranges that fall inside, overlap, or fall outside of these values). The reduction of concrete (or other fill material) reduces the material costs and labor costs typically required to transport and pour the concrete into traditional concrete shear resisting systems. Moreover, the modular post-tensioned shear system 1 has a smaller profile (e.g., smaller wall thickness) than traditional concrete shear systems, which allows the structure to be designed with larger cores, a larger floor space, or the like, and allows for more flexibility when designing systems for retrofitting older structures with a modular post-tensioned shear resisting system 1.

Furthermore, the post tensioning assembly 100, and thus the HSS post tensioning system 150, creates self-centering behavior (otherwise described as realignment) of the post-tensioned shear resisting system 1. After loading, such as seismic loading, the post-tensioning pulls the post-tensioning shear resisting system 1 (e.g., wall, core, or the like) back to its neutral (or original) position. In traditional systems, while the buildings are designed to remain standing during a seismic event, permanent displacement of the building (e.g., in the walls) will likely occur. These traditional systems are expensive to repair, and in some cases require complete replacement. As such, the post-tensioned shear resisting system 1 of the present disclosure provides improved self-centering that in many instances results in no permanent damage, whereas concrete shear resisting system likely would be permanently displaced and require complete replacement.

However, it should be further understood that the use of the post-tensioning assembly 100 having the one more conduit members 102 and/or the one or more tensioning members 112 allows for the improved ability to remove and replace one or more members of the post-tensioning assembly 100 for repair and/or replacement (e.g., if necessary, after a seismic event, for general maintenance, or the like). For example, the post-tensioning assembly 100 may be un-tensioned (e.g., at the tensioning lock 120) from the top of the modular post-tensioning shear system 1 and at the base module, and two or more tensioning members may be removed from the conduit members 102. As the two or more tensioning members 112 are being removed, each individual tensioning member 112 may be decoupled from the adjacent tensioning member 112 as the two or more tensioning members 112 are removed (e.g., by a crane, lift, hydraulic system, or the like). The one or more tensioning members 112 may be replaced and reinserted into the conduit members 102 by adding one tensioning member 112 at a time and lowering the coupled tensioning members 112 until the first tensioning member 112 can be recoupled at the base module and re-tensioned at the top module 10 (e.g., through the use of the tensioning lock 120). As such, the modular post-tensioning shear system 1 also allows for improved removal and replacement of the tensioning members 112.

Moreover, the use and/or assembly of the energy dissipation devices 200 between the base module 16 and/or the foundation and the first modular section 12, and/or within the form walls 40 of the modular sections 10 makes for improved connections, which can also be accessed and replaced when needed (e.g., after a loading event that deforms the energy dissipation devices 200).

Regardless of whether or not the post-tensioned shear system 1 is a single wall, multiple walls, a core, or the like, the system can be modified and installed easily either as a component of new buildings or in order to retrofit older buildings such that the older buildings can be brought into compliance with new code.

It should be understood that "operatively coupled," when used herein, means that the components may be formed integrally with each other, or may be formed separately and coupled together. Furthermore, "operatively coupled" means that the components may be formed directly to each other, or to each other with one or more components located between the components that are operatively coupled together. Furthermore, "operatively coupled" may mean that the components are detachable from each other, or that they are permanently coupled together.

Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" shall mean "one or more."

Certain terminology is used herein for convenience only and is not to be taken as a limiting, unless such terminology is specifically described herein for specific embodiments. For example, words such as top, bottom, upper, lower, vertical, horizontal, longitudinal, lateral, or the like may merely describe the configurations shown in the Figures and described herein for some embodiments of the invention. Indeed, the components may be oriented in any direction and the terminology, therefore, should be understood as encompassing such variations unless specified otherwise. The terminology includes the words specifically mentioned above, derivatives thereof and words of similar import.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

What is claimed is:

1. A modular post-tensioned shear system, the system comprising:

two or more modular sections stacked on top of each other, wherein each of the two or more modular sections comprise:

two boundary hollow structural section (HSS) members;

a form wall operatively coupled between the two boundary HSS members;

a post tensioning assembly in each of the two boundary HSS members;

two or more HSS couplings, wherein the two or more HSS couplings comprise:

one or more brackets; and a plurality of fasteners;

wherein a lower end of each of the two boundary HSS members of an upper module is operatively coupled to an upper end of the two boundary HSS members of a lower module through an HSS coupling of the two or more HSS couplings.

2. The system of claim 1, wherein the post tensioning assembly in each of the two boundary HSS members comprises:

two or more conduit members operatively coupled together.

3. The system of claim 2, wherein ends of adjacent conduit members are operatively coupled through a conduit coupling.

4. The system of claim 2, wherein the post tensioning assembly further comprises in each of the two boundary HSS members:

two or more tensioning members operatively coupled together located within the two or more conduit members.

5. The system of claim 4, wherein ends of adjacent tensioning members are operatively coupled through a tensioning coupling.

6. The system of claim 5, wherein the ends of the two or more tensioning members comprise threaded bar ends, and wherein the tensioning coupling comprises internal threads for operatively coupling the ends of the adjacent tensioning members.

7. The system of claim 5, wherein the two or more tensioning members comprise two or more cables, and wherein the tensioning coupling comprises a cable coupling.

8. The system of claim 4, wherein the post tensioning assembly further comprises:

a tensioning lock that tensions the two or more tensioning members of the post tensioning assembly.

9. The system of claim 8, wherein the tensioning lock comprises:

a bearing member operatively coupled to an upper surface of a top HSS member or a top conduit member; and a locking nut operatively coupled to an end of a top tensioning member;

wherein locking nut tensions the two or more tensioning members as the locking nut bears against the bearing member and pulls on the two or more tensioning members.

10. The system of claim 4, wherein the post tensioning assembly in each of the two boundary HSS members further comprises:

conduit fill material, wherein the two or more conduit members are filled with the conduit fill material around the two or more tensioning members after the two or more tensioning members are tensioned.

11. The system of claim 1, wherein lattice members are operatively coupled between the two boundary HSS members.

12. The system of claim 11, wherein the two boundary HSS members each comprise four sides and a plurality of coupling members are operatively coupled to the HSS members and the lattice members.

13. The system of claim 2, wherein HSS fill material is located between an inner surface of each of the two boundary HSS members and an outer surface of each of the two or more conduit members.

14. The system of claim 1, wherein the form wall comprises:

a plurality of wall members; and one or more panels operatively coupled to the plurality of wall members.

15. The system of claim 14, wherein the plurality of wall members comprise:

vertical members;

longitudinal members operatively coupled between the vertical members; and transverse members operatively coupled between the longitudinal members;

wherein the one or more panels are operatively coupled to the longitudinal members; and wherein the vertical members are operatively coupled to the two boundary HSS members.

16. The system of claim 14, wherein the one or more panels comprise fluted decking.

17. The system of claim 14, wherein the one or more panels forms a wall cavity, and wherein the wall cavity is filled with a wall fill material.

18. The system of claim 1, wherein each of the two or more modular sections comprise:

a third boundary HSS member; and a second form wall between the third boundary HSS member and a second boundary HSS member;

wherein the two or more modular sections comprise L-shaped modular sections.

19. The system of claim 18, wherein each of the two or more modular sections comprise:

a fourth boundary HSS member;

a third form wall between the third boundary HSS member and the fourth boundary HSS member; and a fourth form wall between the fourth boundary HSS member and a first boundary HSS member;

wherein the two or more modular sections comprise square shaped or rectangular shaped modular sections.

20. The system of claim 1, further comprising:

one or more energy dissipation devices;

wherein the one or more energy dissipation devices operatively couple a first wall portion to a second wall portion of the form wall or operatively coupled the two or more modular sections to a base module.

21. The system of claim 20, wherein the one or more energy dissipation devices comprise a ductile fuse, a viscous damper, or a bucking brace.

22. The system of claim 20, wherein the one or more energy dissipation devices comprise a wall energy dissipation device, and wherein at least one of the two or more modular sections further comprise:

a first intermediate HSS member operatively coupled to the first wall portion of the form wall and a first end of the wall energy dissipation device; and a second intermediate HSS member operatively coupled to a second end of the wall energy dissipation device and the second wall portion of the form wall.

23. A modular post-tensioned shear system, the system comprising:

two or more modular sections stacked on top of each other, wherein each of the two or more modular sections comprise:

two boundary hollow structural section (HSS) members, wherein each boundary HSS member has four sides;

a plurality of coupling members operatively coupled to each HSS member;

a form wall having lattice members operatively coupled between the two boundary HSS members by the plurality of coupling members; and a post tensioning assembly in each of the two boundary HSS members;

wherein a lower end of each of the two boundary HSS members of an upper module is operatively coupled to an upper end of the two boundary HSS members of a lower module.

24. A modular post-tensioned shear system, the system comprising:

two or more modular sections stacked on top of each other, wherein each of the two or more modular sections comprise:

two boundary hollow structural section (HSS) members;

a form wall comprising:

a plurality of wall members having:

two or more vertical members;

two or more longitudinal members operatively coupled between the vertical members;

two or more transverse members operatively coupled between the longitudinal members; and one or more panels operatively coupled to the longitudinal members;

wherein the form wall is operatively coupled between the two boundary HSS members through the two or more vertical members; and a post tensioning assembly in each of the two boundary HSS members;

wherein a lower end of each of the two boundary HSS members of an upper module is operatively coupled to an upper end of the two boundary HSS members of a lower module.

25. A modular post-tensioned shear system, the system comprising:

two or more modular sections stacked on top of each other, wherein each of the two or more modular sections comprise:

two boundary hollow structural section (HSS) members;

a form wall operatively coupled between the two boundary HSS members; and a post tensioning assembly in each of the two boundary HSS members;

one or more energy dissipation devices, wherein at least one energy dissipation device comprises a wall energy dissipation device;

wherein the form wall of at least one of the two or more modular sections further comprises:

a first intermediate HSS member operatively coupled to a first wall portion of the form wall and a first end of the wall energy dissipation device; and a second intermediate HSS member operatively coupled to a second end of the wall energy dissipation device and a second wall portion of the form wall; and wherein a lower end of each of the two boundary HSS members of an upper module is operatively coupled to an upper end of the two boundary HSS members of a lower module.

* * * * *